US007329812B2

(12) United States Patent
Kuwahara et al.

(10) Patent No.: US 7,329,812 B2
(45) Date of Patent: Feb. 12, 2008

(54) ELECTRONIC MUSICAL INSTRUMENT

(75) Inventors: Shigetoshi Kuwahara, Hamamatsu (JP); Hiroki Nakaya, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 50 days.

(21) Appl. No.: 10/803,628

(22) Filed: Mar. 17, 2004

(65) Prior Publication Data

US 2004/0182223 A1 Sep. 23, 2004

(30) Foreign Application Priority Data

Mar. 18, 2003 (JP) ..... 2003-073015
Oct. 15, 2003 (JP) ..... 2003-355709
Nov. 28, 2003 (JP) ..... 2003-400555

(51) Int. Cl.
*G10H 1/32* (2006.01)
*G10H 3/00* (2006.01)

(52) U.S. Cl. ..... 84/744; 84/80; 84/423 R

(58) Field of Classification Search ..... 84/423 R, 84/80, 744, 719
See application file for complete search history.

(56) References Cited

U.S. PATENT DOCUMENTS

| | | | | |
|---|---|---|---|---|
| 1,578,317 | A | 3/1926 | Johanson | |
| 2,554,665 | A * | 5/1951 | Day | 84/179 |
| 4,635,521 | A | 1/1987 | Bellini | |
| 4,939,969 | A * | 7/1990 | Taguchi et al. | 84/719 |
| 6,130,371 | A | 10/2000 | Inoue | |
| 6,147,290 | A * | 11/2000 | Uno | 84/433 |
| 6,259,006 | B1 * | 7/2001 | Parienti | 84/171 |
| 2002/0017187 | A1 | 2/2002 | Takahashi | |
| 2003/0221537 | A1 * | 12/2003 | Hara | 84/179 |

FOREIGN PATENT DOCUMENTS

| | | | |
|---|---|---|---|
| JP | 48-13031 U | | 2/1973 |
| JP | 2-58796 | | 4/1990 |
| JP | 08-083063 | | 3/1996 |
| JP | 08083063 | * | 3/1996 |
| JP | 09-325760 | | 12/1997 |
| JP | 11-65552 | | 3/1999 |
| JP | 11-175053 | | 7/1999 |
| JP | 11-282337 | | 10/1999 |
| JP | 2000-338962 | | 12/2000 |
| JP | 2002-062865 | | 2/2002 |
| JP | 2002062865 | * | 2/2002 |

* cited by examiner

*Primary Examiner*—Jeffrey W Donels
(74) *Attorney, Agent, or Firm*—Morrison & Foerster LLP

(57) ABSTRACT

An electronic musical instrument which has a fallboard unit whose dimension in the longitudinal direction of the instrument is not increased even when the fallboard unit contains a functional component part including electrical wiring. A cover unit has a front cover and a rear cover disposed such that they are arranged in forward and rearward directions when the cover unit is closed. A hinge device pivotally connects the front cover and the rear cover such that the cover unit lays open upward a keyboard when it is open with the front cover and the rear cover being folded. An instrument body accommodates the keyboard and a musical tone generator, and includes a pivotal support member fixed therein, left and right lateral side panels, and a topboard. A guide mechanism is provided on the left and right lateral side panels, and supports the rear cover such that the rear cover is movable in the forward and rearward directions. A lower part of the rear end of the front cover below the hinge device is pivotally supported by the pivotal support member. The topboard is below the front end of the front cover when the front cover is open.

17 Claims, 19 Drawing Sheets

ELECTRONIC MUSICAL INSTRUMENT

BACKGROUND OF THE INVENTION

1. Field of the Invention

The present invention relates to an electronic musical instrument typified by an electronic keyboard instrument, such as an electronic piano or an electronic organ. The electronic musical instrument to which the present invention is applicable includes not only an electronic keyboard instrument, such as an electronic piano or an electronic organ, but also a musical instrument, such as an acoustic piano, a pipe organ, a cembalo or a celesta, which is provided with a keyboard and musical tone control operators. In recent years, more and more acoustic keyboard instruments have come to incorporate a performance recording and reproducing device and a performance assist device for giving a key-depressing instruction or the like, and the present invention is useful in mounting functional components which are large in thickness, such as control operating elements, in the interior of a fallboard.

2. Description of the Related Art

There has been proposed an electronic keyboard instrument of the above-mentioned kind, in which an operation panel having electric component parts forming operators arranged thereon for setting tone colors and other parameters is formed integrally on an inner surface of a fallboard (see Japanese Laid-Open Patent Publication No. S60-122989). In this electronic keyboard instrument, the operation panel functions as a fallboard, and therefore the operation panel pivotally supports the rear end of the fallboard on the body of the musical instrument so that during musical performance, various musical tone parameters can be set using the operators on the operation panel, with the fallboard being in an open state.

In this electronic keyboard instrument, since the fallboard is designed to function not only as a fallboard but also as an operation panel, the thickness thereof is inevitably increased. As a result, there is some distance between a surface of the keyboard and upper surfaces of loudspeakers disposed on the left and right sides of the keyboard, so that when the player is playing a musical composition having dynamic and quick passages with quick and large pitch changes, the player's hands or fingers sometimes hit side surfaces of the loudspeakers, which degrades the performance. This problem could be solved by increasing the width of each cheekblock, but this increases the whole width of the musical instrument.

Further, the above conventional electronic keyboard instrument has a pivotal motion support configured to have a large size so as to increase the rigidity of the support and ensure the stability of pivotal motion of the fallboard. Otherwise, the fallboard cannot be stable in its up or raised position. Furthermore, to hold the thick fallboard as it is in the up or raised position, a space for receiving the fallboard, corresponding to the thickness of the fallboard, has to be provided at the rear of the fallboard, which not only makes it impossible to design the electronic keyboard instrument compact in size, but also seriously spoils the appearance of the electronic keyboard instrument.

When an electronic keyboard instrument has a large-sized fallboard, a large force is required to open and close the fallboard, and safety at the start and end of opening and closing operations cannot be assured. One known solution to this problem is a construction in which divided parts of the fallboard are connected to each other. For example, there has been proposed an electronic keyboard instrument disclosed in Japanese Laid-Open Patent Publication No. H11-175053, which has a construction in which the fallboard pivotally moves and retreats when it is opened. In this electronic keyboard instrument, as shown in FIGS. 11A and 11B, the fallboard which extends substantially horizontally in its closed state is divided into a front cover 106*a* and a rear cover 106*b*, and the two covers 106*a*, 106*b* are connected by a hinge member 107. The front cover 106*a* has arms 108 extending downward from the respective opposite lateral side edges thereof at the rear end thereof, and the arms 108 are pivotally supported on a pivot 114*a*. The rear cover 106*b* has a rear end thereof slidably supported on manual cover guides 103. In this construction, to open the fallboard, the front cover 106*a* turns about the pivot 114*a* of the arms 108, and this motion of the front cover 106*a* causes a rearward sliding motion of the rear cover 106*b* via the hinge member 107. At the rear of the fallboard, a front panel, not shown, which has approximately the same height as the depth of the fallboard is fixed in a raised position, and when the fallboard is fully opened, the front cover 106*a* is tilted toward the front panel into a raised position in which it abuts on stoppers 124 formed on respective lateral side panels to be supported thereon.

However, this electronic keyboard instrument is configured such that an upper part of the body of the instrument is covered by the front panel fixed in the raised position, and when the fallboard is in the open or raised position, the fallboard has its uppermost part lying at a level lower than the height of the front panel. That is, the front panel rises high from behind the fallboard, and a topboard mounted on top of the front panel is at a high position. This construction makes the electronic keyboard instrument bulky in the vertical direction, and makes the player feel oppressed when he plays.

To lower the position of the topboard and reduce the height of the front panel or omit the front panel, there have been proposed a construction in which the entire fallboard is supported in a manner slidable in the forward and rearward directions, and when the fallboard is opened, it is moved rearward to be received below the topboard, and a construction in which when the fallboard is in the open position, it is moved rearward to be rolled up. However, neither of these constructions can add a quality appearance of a pivotable fallboard that originates in an acoustic piano to an electronic keyboard instrument. Further, such a fallboard is opened by being pushed under the topboard, not by being raised upward as in the case of the pivotable fallboard, so that it is inferior to the pivotable fallboard in the simplicity and ease of operation.

SUMMARY OF THE INVENTION

It is a first object of the present invention to provide an electronic musical instrument having a fallboard unit whose dimension in the longitudinal direction of the electronic musical instrument is not increased even when a functional component part including electrical wiring is built into the fallboard unit.

It is a second object of the present invention to provide an electronic musical instrument that is capable of reducing the height of the instrument body by limiting the vertical dimension of a part thereof above the keyboard, and at the same time is provided with a pivotable fallboard.

To attain the above objects, in a first aspect of the present invention, there is provided an electronic musical instrument comprising a keyboard that is operated for performance, a cover unit that includes a front cover and a rear cover each having a front end and a rear end, the front cover and the rear cover being disposed such that the front cover and the rear cover are arranged in forward and rearward directions when the cover unit is in a closed state, and a hinge device pivotally connecting the front cover and the rear cover such that the cover unit lays open upward the keyboard when the cover unit is in an open state where the front cover and the rear cover are folded, a musical tone generator that generates musical tones, an instrument body that accommodates the keyboard and the musical tone generator, the instrument body including at least one pivotal support member fixed therein, left and right lateral side panels, and a topboard, and a guide mechanism that is provided on the left and right lateral side panels, the guide mechanism supporting the rear cover such that the rear cover is movable in the forward and rearward directions, wherein the rear end of the front cover has a lower part pivotally supported by the pivotal support member, the lower part being located below the hinge device, and wherein the topboard is disposed such that the topboard is below the front end of the front cover when the front cover is in the open state.

With this arrangement of the first aspect of the invention, the topboard is disposed such that the topboard is below the front end of the front cover when the front cover is in the open state. That is, the topboard is located at a low level. This makes it possible to limit the height of the whole instrument body.

To attain the above objects, in a second aspect of the present invention, there is provided an electronic musical instrument comprising a keyboard that is operated for performance, a cover unit that includes a front cover and a rear cover each having a front end and a rear end, the front cover and the rear cover being disposed such that the front cover and the rear cover are arranged in forward and rearward directions when the cover unit is in a closed state, and a hinge device pivotally connecting the front cover and the rear cover such that the cover unit lays open upward the keyboard when the cover unit is in an open state where the front cover and the rear cover are folded, at least one functional component having electrical wiring, a musical tone generator that generates musical tones, an instrument body that accommodates the keyboard and the musical tone generator, the instrument body including at least one pivotal support member fixed therein, left and right lateral side panels, and a topboard, and a guide mechanism that is provided on the left and right lateral side panels, the guide mechanism supporting the rear cover such that the rear cover is movable in the forward and rearward directions, wherein the rear end of the front cover has a lower part pivotally supported by the pivotal support member, the lower part being located below the hinge device, and wherein the functional component is mounted in the front cover such that the functional component has a front face thereof facing toward a player when the cover unit is in the open state.

With this arrangement of the second aspect of the present invention, the functional component having electrical wiring is mounted in the front cover such that the functional component has a front face thereof facing the player when the cover unit is open. Therefore, no space is needed for arranging functional components necessary for the electronic keyboard instrument between the keyboard and the topboard. This makes it possible to reduce the size of the musical instrument in the longitudinal direction and protect the functional components when they are not in use.

To attain the above objects, in a third aspect of the present invention, there is provided an electronic musical instrument comprising a keyboard that is operated for performance, a cover unit that includes a front cover and a rear cover each having a front end and a rear end, the front cover and the rear cover being disposed such that the front cover and the rear cover are arranged in forward and rearward directions when the cover unit is in a closed state, and a hinge device pivotally connecting the front cover and the rear cover such that the cover unit lays open upward the keyboard when the cover unit is in an open state where the front cover and the rear cover are folded, at least one functional component having electrical wiring, a musical tone generator that generates musical tones, an instrument body that accommodates the keyboard and the musical tone generator, the instrument body including at least one pivotal support member fixed therein, a predetermined mechanism that supports the rear cover such that the rear cover is movable in the forward and rearward directions, left and right lateral side panels, wherein the rear end of the front cover has a lower part pivotally supported by the pivotal support member, the lower part being located below the hinge device, and wherein the functional component is mounted in the front cover such that the functional component has a front face thereof facing toward a player when the cover unit is in the open state.

With this arrangement, substantially the same effects as those of the second aspect described above can be provided.

Preferably, the functional component comprises at least one loudspeaker built in the front cover.

With this arrangement of this preferred form, the player can hear musical sound directly and accurately from the loudspeakers built in the front cover, not from rear loudspeakers installed in the instrument body or from external loudspeakers outside the electronic musical instrument, when he performs with the cover unit being in the open state.

Preferably, the functional component includes an electronic display.

To attain the above objects, in a fourth aspect of the present invention, there is provided an electronic musical instrument comprising a topboard having a lower surface, a plurality of juxtaposed operating elements, a cover unit that covers the plurality of operating elements, the cover unit including a front cover and a rear cover each having a front end and a rear end, the front cover and the rear cover being disposed such that the front cover and the rear cover are arranged in forward and rearward directions when the cover unit is in a closed state, and a hinge device pivotally connecting the front cover and the rear cover such that the cover unit lays open upward the keyboard when the cover unit is in an open state where the front cover and the rear cover are folded, an instrument body that accommodates the plurality of operating elements, the instrument body including pivotal support members disposed laterally outward of the plurality of juxtaposed operating elements, the instrument body having an upper part thereof formed by the cover unit and the topboard, and at least one link member that allows the rear cover to move while acting as a damper member, the link member having one end and another end, wherein the pivotal support members are located below the hinge device and pivotally support the front cover, and wherein the rear cover has a rear end thereof pivotally supported by the one end of the link member such that the rear cover pivotally moves about the one end when the cover unit is pivotally moved about the hinge device and the pivotal support members into the open state or into the closed state, the other end of the link member being supported by the instrument body in a vicinity of the lower surface of the topboard.

With this arrangement of the fourth aspect of the present invention, the link member functions as a guide member for guiding the rear end of the rear cover, but the component elements necessary for the function of the guide member are operated by each other's pivotal motion, so that no sliding friction which can be produced when sliding motion is involved in the guiding operation can be produced. This is advantageous in achieving smooth opening and closing operations of the cover unit.

To attain the above objects, in a fifth aspect of the present invention, there is provided an electronic musical instrument comprising a plurality of juxtaposed operating elements, a cover unit that covers the plurality of operating elements, the cover unit including a front cover and a rear cover each having a front end and a rear end, the front cover and the rear cover being disposed such that the front cover and the rear cover are arranged in forward and rearward directions when the cover unit is in a closed state, and a hinge device pivotally connecting the front cover and the rear cover such that the cover unit lays open upward the keyboard when the cover unit is in an open state where the front cover and the rear cover are folded, a load reducing device that reduces load applied to the front cover due to a weight of the front cover when the cover unit is opened and closed, and an instrument body that includes at least one pivotal support member fixed therein, the hinge device extending in a transverse direction of the instrument body, wherein the pivotal support member is located below the hinge device and pivotally supports the front cover, and wherein the load reducing device comprises at least one resilient member that has a resistance force thereof increased against a motion of the front cover toward a fully open position or a fully closed position of the cover unit as the front cover approaches the fully open position or the fully closed position, the resilient member having one end thereof connected to the instrument body, and another end thereof connected to the front cover at a location remote from the hinge device in a direction perpendicular to the transverse direction of the instrument body in which the hinge device extends.

With this arrangement of the fifth aspect of the present invention, the force necessary for supporting the free end of the front cover can be made more uniform over the entire range of pivotal motion of the front cover, so that it is possible to avoid a marked increase in the force necessary for supporting the front cover particularly when the cover unit approaches its fully open or closed position. In particular, the front cover equipped with functional components are often designed to have an increased weight, which increases the force necessary for supporting the front cover when the cover unit approaches its fully open or closed position. Therefore, the damper mechanism including the resilient member is very advantageous.

Preferably, the predetermined mechanism comprises at least one link member pivotable about a predetermined pivot provided on the instrument body.

Preferably, the predetermined mechanism comprises guide grooves provided in the left and right lateral side panels.

To attain the above objects, in a sixth aspect of the present invention, there is provided an electronic musical instrument comprising a plurality of performance operating elements, an instrument body that accommodates the plurality of performance operating elements, the instrument body including at least one pivotal support member fixed therein, a fallboard unit that covers the plurality of performance operating elements, the fallboard unit including a first fallboard member and a second fallboard member, the first fallboard member having a free end and another end, the second fallboard member having one end, the first fallboard member and the second fallboard member being disposed such that the first fallboard member and the second fallboard member are arranged in forward and rearward directions when the fallboard unit is in a closed state, and a hinge device pivotally connecting the other end of the first fallboard member and the one end of the second fallboard member, and at least one functional component having electrical wiring, wherein the first fallboard member has at least one pivotal motion support disposed such that the pivotal motion support is positioned inward of the hinge device when the fallboard unit is in a closed state, the pivotal motion support being pivotally supported by the pivotal support member, wherein the first fallboard member has an upper surface extending between the free end of the first fallboard member and the hinge device, and a lower surface extending between the free end of the first fallboard member and the pivotal motion support, the functional component being disposed in a space defined between the upper surface of the first fallboard member and the lower surface of the first fallboard member.

With this arrangement of the sixth aspect of the present invention, the pivotal motion support is positioned inward of the hinge device, and the first fallboard member pivotally moves about the pivotal motion support, so that it is possible to reduce the range of pivotal motion of the first fallboard member in the longitudinal direction. This makes it possible to reduce the space within the instrument body in the longitudinal direction. Therefore, even when the first fallboard member has at least one functional component part including electrical wiring built therein, it is possible to make the electronic musical instrument compact in depth.

Preferably, the upper surface and the lower surface of the first fallboard member progressively become closer to each other toward the free end of the first fallboard member such that the first fallboard member has a thickness thereof progressively reduced.

With this arrangement of the preferred form, the front end of the first fallboard member has a reduced thickness, which reduces the weight of the fallboard unit, and therefore, rotation moment caused by the weight of the fallboard is limited. This makes it possible to reduce the force required for the operator to assist the opening and closing motion of the fallboard unit. This facilitates the operation of adjusting the force for supporting the fallboard unit so as to ensure smooth opening and closing motions, and makes it possible to open the fallboard unit with a small force. Further, since the thickness of fallboard unit is progressively reduced toward the front end thereof, the front end of the electronic musical instrument is reduced in thickness when the fallboard unit is closed. This prevents the player sitting at the electronic musical instrument from feeling oppressed. Furthermore, the space necessitated by the fallboard unit when it is open becomes compact, so that even if the instrument body is reduced in depth, the fallboard unit can be made sufficiently wide open.

Preferably, the first fallboard member has a lower surface part provided at the lower surface and serving as an underside cover, and the upper surface and the lower surface progressively become more distant from each other toward the other end of the first fallboard member, the upper surface and the lower surface of the first fallboard member being spaced at the other end of the first fallboard member to a distance corresponding to a thickness defined by the hinge device and the pivotal motion support, and the functional component being disposed at a location rearward of a halfway point between the free end of the first fallboard member and the hinge device.

Preferably, the electronic musical instrument comprises a protective member provided on the lower surface of the first fallboard member, for protecting the functional component.

More preferably, the functional component is secured to the protective member.

Preferably, the functional component is a display device.

Preferably, the functional component is a sound generator.

Preferably, the second fallboard member has a free end disposed in opposed relation to the hinge device, the free end being movable in a longitudinal direction of the instrument body.

Preferably, the electronic musical instrument further comprises a link member, and the free end of the second fallboard member is made movable by the link member.

Further preferably, the electronic musical instrument comprises a guide mechanism provided in the instrument body, for enabling the second fallboard member to move.

Preferably, the guide mechanism is disposed at an upper location within the instrument body.

More preferably, sad second fallboard member includes at least one engaging member, and the guide mechanism comprises at least one groove in which the engaging member is slidably fitted.

The above and other objects, features, and advantages of the invention will become more apparent from the following detailed description taken in conjunction with the accompanying drawings.

BRIEF DESCRIPTION OF THE DRAWINGS

FIGS. 11A and 11B are longitudinal cross-sectional views of a conventional electronic keyboard instrument, in which:

FIG. 11A shows a state where a fallboard is open; and

FIG. 11B shows a state where the fallboard is closed;

FIGS. 12A and 12B are longitudinal cross-sectional views schematically showing a conventional electronic keyboard instrument with a front cover having loudspeakers built therein, in which:

FIG. 12A shows a state where a fallboard is closed; and

FIG. 12B shows a state where the fallboard is open;

DETAILED DESCRIPTION OF THE PREFERRED EMBODIMENTS

Figure 1:
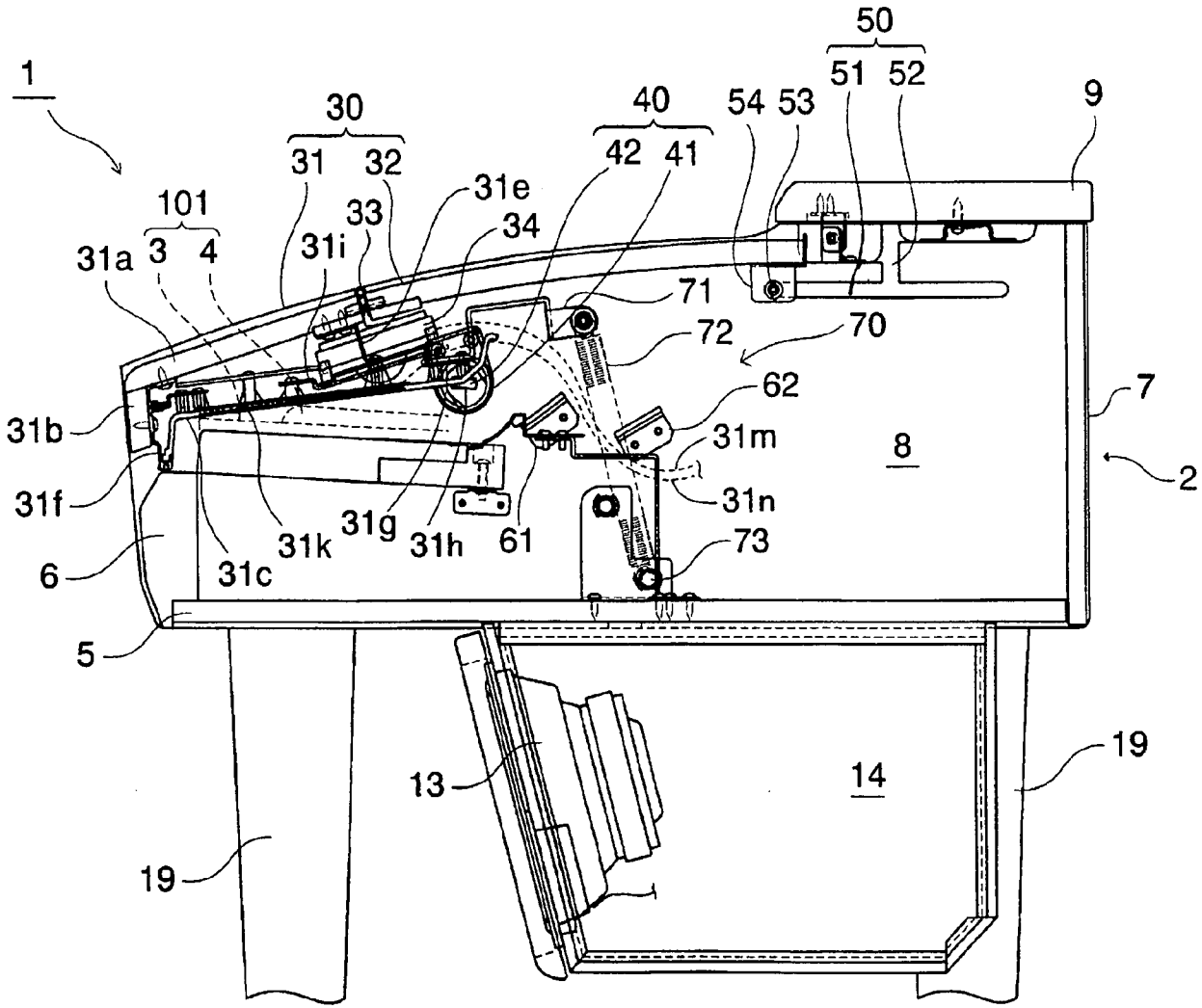
FIG. 1 is a longitudinal cross-sectional view of an electronic keyboard instrument as an electronic musical instrument according to a first embodiment of the present invention, in a state where a cover unit is closed.

The present invention will now be described in detail below with reference to the drawings showing preferred embodiments thereof. In the drawings, elements and parts which are identical throughout the views are designated by identical reference numerals, and duplicate description thereof is omitted.

It should be noted that each of the embodiments described below is given only by way of example, and various changes and modifications may be made thereto without departing from the spirit and scope of the present invention.

A first embodiment of the present invention will now be described with reference to FIGS. 1 to 4, in which the present invention is applied to an electronic musical instrument.

Figure 2:
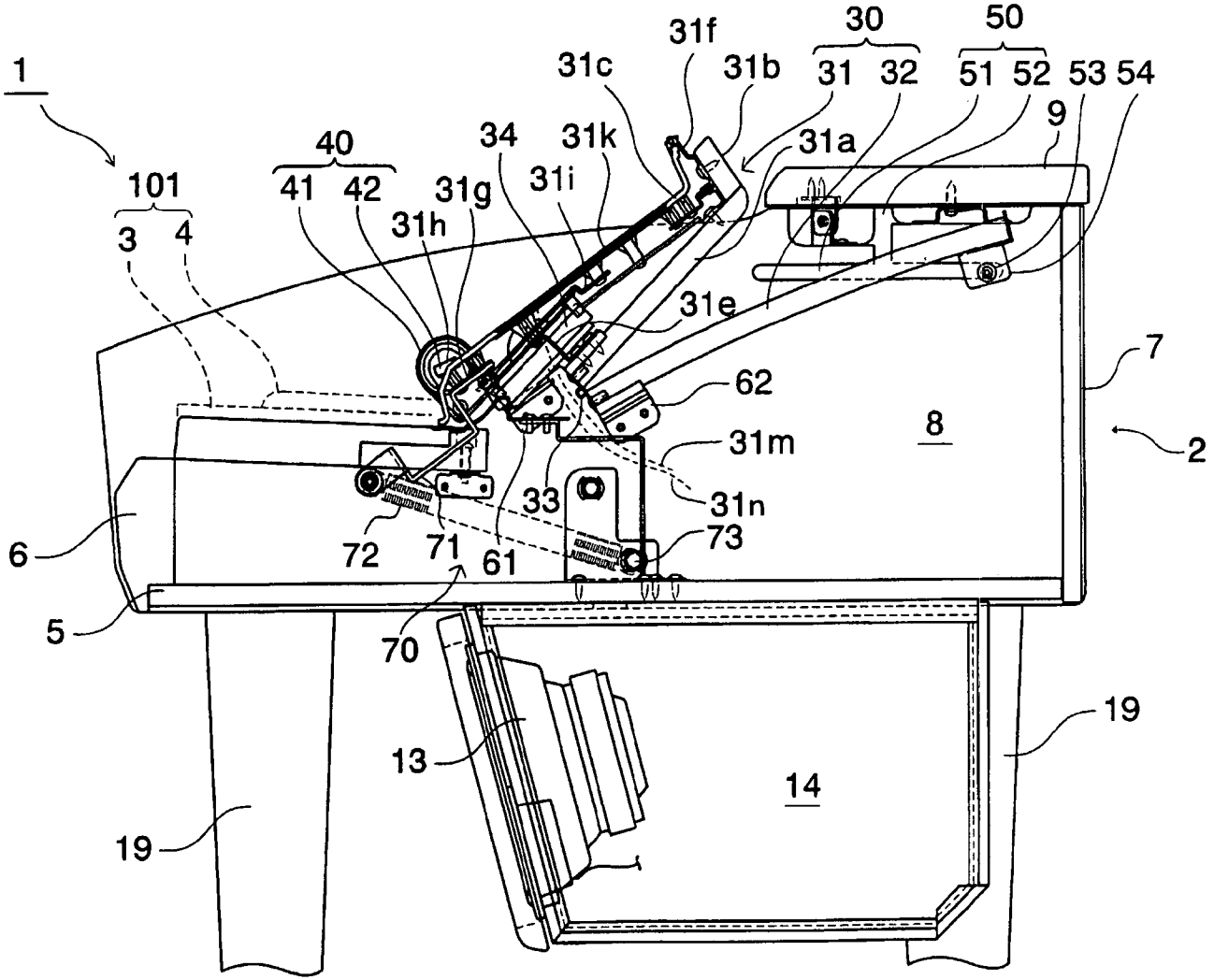
FIG. 2 is a longitudinal cross-sectional view of the electronic keyboard instrument shown in FIG. 1, in a state where the cover unit is open.
Figure 3:
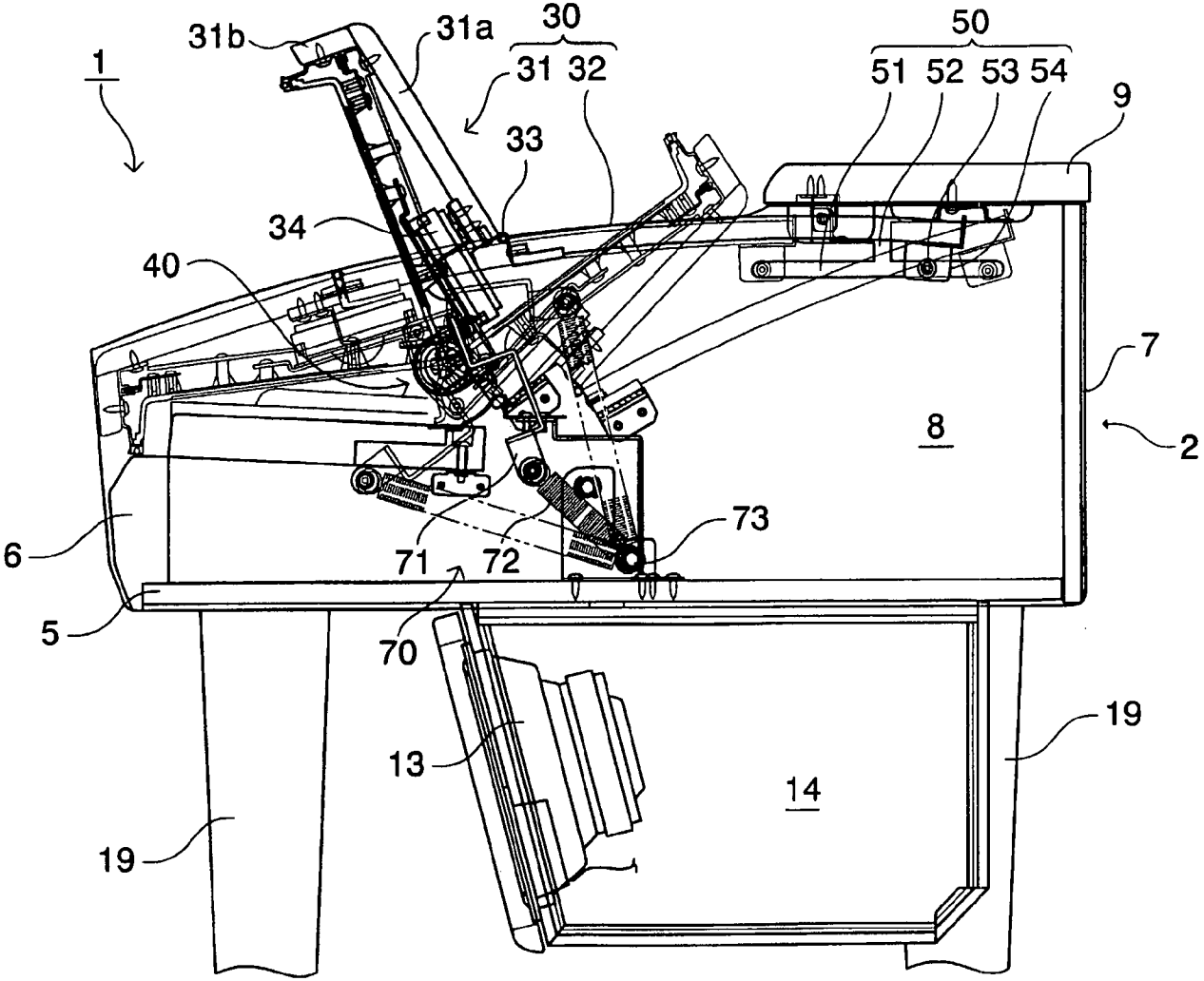
FIG. 3 is a longitudinal cross-sectional view of the electronic keyboard instrument shown in FIG. 1, in a state where the cover unit is in an intermediate position between a fully open position and a fully closed position.
Figure 4:
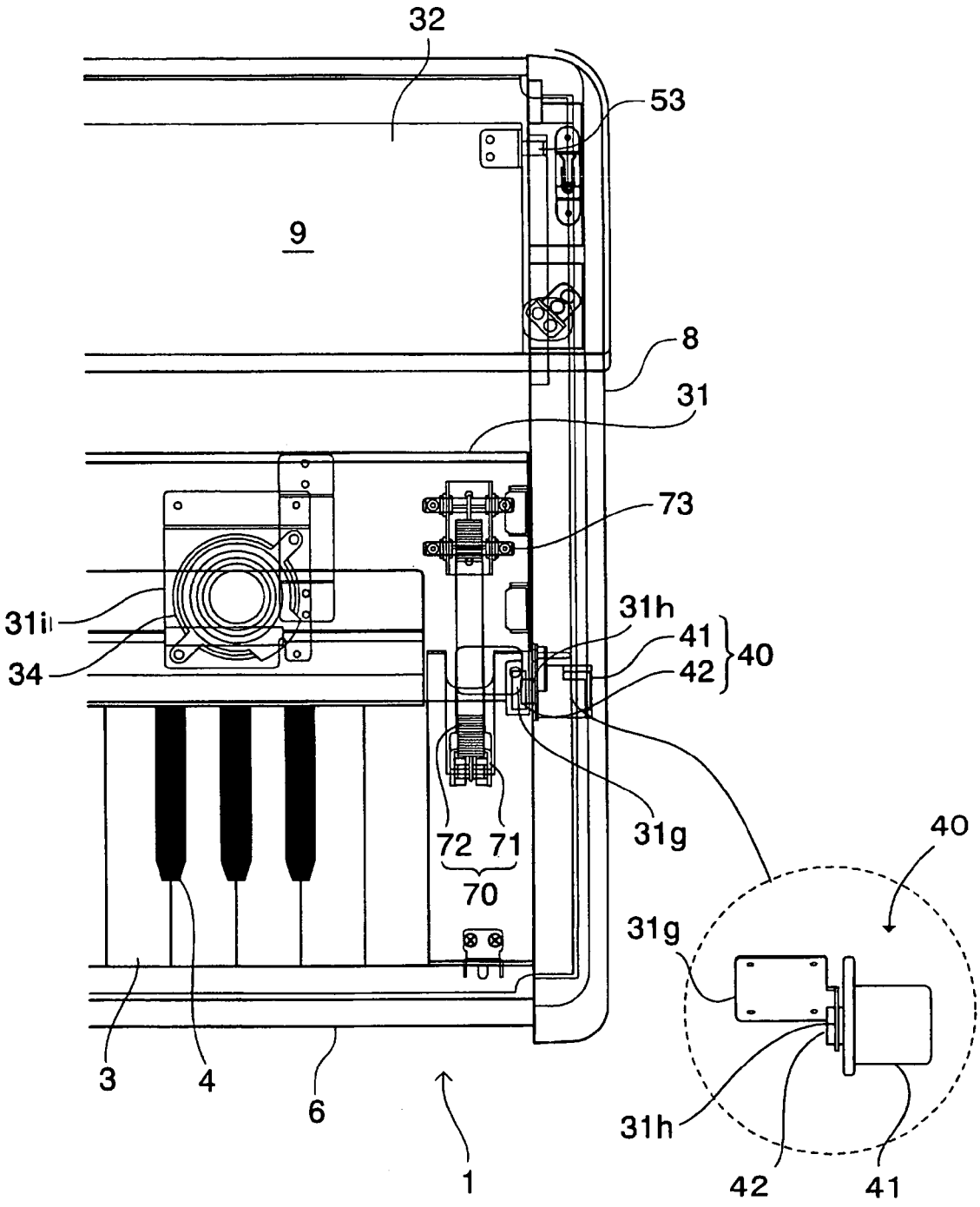
FIG. 4 is a fragmentary plan view showing a part of the electronic keyboard instrument shown in FIG. 1, in the state where the cover unit is open.

In the present embodiment, the electronic musical instrument is implemented by an electronic keyboard instrument, such as an electronic piano or an electronic organ. FIGS. 1 to 3 are longitudinal cross-sectional views of the electronic keyboard instrument 1. FIG. 1 shows a state where a cover unit also serving as a fallboard is closed, FIG. 2 shows a state where the cover unit is open, and FIG. 3 shows a state where the cover unit is in an intermediate position between a fully open position and a fully closed position, i.e. half open or closed. Further, FIG. 4 shows a part of the electronic keyboard instrument 1 with the cover unit being in an open state. In the following description, a player's side of the electronic keyboard instrument will be referred to as "front", and a rear panel side as "rear". Directions indicated by "left" and "right" are directions as viewed from the player's side.

The electronic keyboard instrument 1 has a keyboard 101 having white keys 3 and black keys 4, and an electronic circuit (not shown) for generation and control of musical tones, all of which are received in an instrument body casing 2. The casing 2 is comprised of a keybed 5 forming a bottom, a keyslip 6 rising from the keybed 5 in a manner covering a front or player-side end face of the keybed 5, a rear panel 7 erected from the keybed 5 and forming a rear wall, left and right lateral side panels 8, a topboard 9 covering an upper surface of the electronic keyboard instrument, a loudspeaker box 14 accommodating main loudspeakers 13, and legs 19 extending downward from the keybed 5. The loudspeaker box 14 is mounted on a central part of a lower surface of the keybed 5 in a transverse direction with respect to the instrument body casing 2, i.e. in a direction in which the white and black keys 3 and 4 are arranged (hereinafter referred to as "the key arrangement direction"). The legs 19 are attached to the left and right ends of a front part of the keybed 5 and the center of a rear part of the keybed 5, respectively. Within the casing 2, there are mounted the electronic circuit for generation and control of musical tones, switches, a controller associated with the electronic circuit, a power supply unit, and connection terminals, none of which are shown.

The keyboard 101 comprised of the white keys 3 and the black keys 4 and a part of the electronic keyboard instrument 1 behind the keyboard 101 are covered by the cover unit (fallboard unit) 30. The cover unit 30 is comprised of a front cover (fallboard front section) 31 and a rear cover (fallboard rear section) 32, which are formed separately from each other and foldably connected to each other. When the cover unit 30 is in a closed position with the front cover 31 and the rear cover 32 being unfolded, it covers a part of the instrument 1 extending over the keyboard 101 from the upper end of the keyslip 6 to the front end of the topboard 9, whereas when the cover unit 30 is in an open position in which the front cover 31 and the rear cover 32 are folded, the upper surface of the keyboard 101 is laid open.

The front cover 31 and the rear cover 32 have upper walls which have opposed ends thereof pivotally connected by a hinge part 33. In the present embodiment, the hinge part 33 is implemented by a hinge continuously transversely extending between opposite lateral side (left and right) edges of the front cover 31 and the rear cover 32. However, this is not limitative, but the hinge part may have any structure that allows pivotal connection between the front cover 31 and the rear cover 32. For example, the hinge part can be implemented by a flexible member extending in a manner bridging between the front cover 31 and the rear cover 32.

The front cover 31 has a sufficient thickness for accommodating loudspeakers 34 and/or other functional components. The hinge part 33 is attached to the rear end of an upper wall of the front cover 31, as viewed in the closed position thereof, and the front cover 31 has opposite lateral side edges thereof at rear portions thereof lying lower than the hinge part 33 and supported by the lateral side panels 8 via pivotal devices 40, respectively. More specifically, the front cover 31 is comprised of the upper wall 31*a* which faces upward when the front cover 31 is in the closed position, a front wall 31*b* extending downward from the front end of the upper wall 31*a*, and a lower wall 31*c* which faces downward when the front cover 31 is in the closed position. These walls transversely extend in the key arrangement direction over such a distance that they cover the entire keyboard. The lower wall 31*c* functions, when the front cover 31 is open, as a control panel on which various operators are disposed for setting musical tone control parameters, such as tone color and effects, and parameters for automatic performance and performance assistance. A liquid crystal display 31*k* is disposed for setting operations using the operators at the center of the lower wall 31*c* in the transverse direction. The upper wall 31*a* and the lower wall 31*c* are connected to each other by a connecting member 31*e*, and the front wall 31*b* and the lower wall 31*c* are connected to each other by a connecting member 31*f*.

In the closed state of the front cover 31, the lower wall 31*c* extends rearward beyond the upper wall 31*a*. The lower wall 31*c* has mounting plates 31*g* fixedly attached to the respective opposite lateral side edges thereof at the rear end thereof, and each of the mounting plates 31*g* has a fitting hole 31*h* formed therein for cooperation with an associated one of the pivotal devices 40 provided on the respective lateral side panels 8. More specifically, the fitting holes 31*h* of the respective mounting plates 31*g* are held in position on the front cover 31, and a rectangular shaft 42 projecting inward from a pivotal support member 41 of each of the pivotal devices 40 is fitted in the associated fitting hole 31*h*, whereby the front cover 31 is made pivotable with respect to the instrument body casing 2.

The rear cover 32 moves in unison with pivotal movement of the front cover 31. A guide mechanism 50 is provided in the instrument body, for guiding the motion of the rear cover 32. The guide mechanism 50 has left and right guide means disposed slightly below the topboard 9 and associated with the respective lateral side panels 8. Here, a description will be given of only one of the pair of guide means, as deemed appropriate. The guide means is comprised of a guide groove 51 extending substantially horizontally, and an introducing groove 52 extending from the guide groove 51 to the upper end of the topboard 9. These grooves 51 and 52 may be directly formed in the lateral side panel 8 or in a member attached to the lateral side panel 8. The rear cover 32 has support plates 54 attached to the rear end thereof, each supporting an engaging pin 53 fitted in the associated guide groove 51.

When the front cover 31 is opened or closed, the guide grooves 51 functions as slide guides for the engaging pins 53 to thereby guide the rear cover 32 as it moves forward or rearward. Alternatively to the above arrangement of the guide grooves 51 and the engaging pins 53, the guide grooves 51 may be formed in the rear cover 32 and the engaging pins 53 may be provided on the lateral side panels 8. Further, the guide groove 51 may be shaped in the form of a desired one of various possible guide paths along which the motion of the rear cover 32 can be guided by the engaging pin 53 as an engaging member. For example, if the guide path is linear, the range of motion of the rear cover 32 is also linear. By thus configuring the guide path in a desired form, it is possible to streamline the operation of the rear cover 32 and make the instrument body compact in size.

Further, the pivotal devices 40 that serve as pivots about which the front cover 31 is turned when it is opened or closed are mounted on the respective lateral side panels 8. Here, a description will be given of only the pivotal device 40 on the right lateral side panel, as deemed appropriate. The pivotal device 40 is comprised of the shaft 42 projecting from the lateral side panel 8, for pivotal motion, and the pivotal support member 41 embedded in the lateral side panel 8 and supporting the shaft 42, and has a known damper function. In the pivotal device 40, when the shaft 42 turns within the pivotal support member 41, the turning motion of the shaft 42 undergoes a resistance force due to contact resistance of internal parts of the pivotal support member 41, whereby the turning motion is slowed down. On the other hand, in the front cover 31, the mounting plate 31*g* as a pivotal member is attached to the front cover 31, and the shaft 42 is fitted in the fitting hole 31*h* of the mounting plate 31*g*, so that the operation of the pivotal device 40 gives an appropriate resistance to the pivotal or turning motion of the front cover 31. By increasing the degree of this action for slowing down the motion of the front cover 31 when the front cover 31 is closed, it is possible to prevent the cover unit 30 from slamming shut or abruptly closed due to its weight.

The pivotal device 40 is disposed at a location below the hinge part 33. This makes it possible to cause the front cover 31 to perform an opening motion and a rearward motion at the same time with the distance between the pivotal support member 41 and the hinge part 33 as a radius of turning motion of the rear end of the front cover 31, whereby a keyboard area below the front cover 31 is laid open (see FIG. 2). To increase this open range, it is preferable that the pivotal device 40 is disposed at a location below and rearward of the hinge part 33. In the present embodiment, with this arrangement, when the cover unit 30 is closed, the connecting part i.e. the hinge part 33 between the front cover 31 and the rear cover 32 is positioned above the keyboard 101, and when the cover unit 30 is open, the front cover 31 and the rear cover 32 are retracted to a position for laying open a space above the keyboard 101.

The front cover 31 and the rear cover 32 are pivotally supported by the hinge part 33 and the pivotal support member 41 below the hinge part 33. As a consequence, the front cover 31 in its open position covers the vicinity of the front end of the topboard 9 and an area below and in front of the topboard 9 in place of the rear cover 32. With this construction, if the dimension in forward and rearward directions of the front cover 31 in its closed position is large, the front cover 31 can project upward from the topboard 9 when it is opened. However, if the dimension of the front cover 31 is determined such that the connecting part between the front cover 31 and the rear cover 32 is positioned above the keyboard 101 when the cover unit 30 is closed, the dimension of the front cover 31 is limited, whereby it is possible to prevent the projection of the front cover 31, thereby ensuring that the front cover 31 covers the vicinity of the front end of the topboard 9 and the area below and in front of the topboard 9. It is preferred that the fitting hole 31*h* into which the shaft 42 of the pivotal device 40 as the pivot is fitted is located below the hinge part 33, and the hinge part 33 is disposed at a location forward of the pivot.

The lateral side panel 8 is provided with stoppers 61 and 62 that come into contact with a part of the front cover 31 in the vicinity of the pivotal device 40 and a part of the rear cover 32 in the vicinity of the hinge part 33, respectively, when the cover unit 30 is in the open position, to stop motions of the front cover 31 and the rear cover 32.

The front cover 31 and the rear cover 32 are thus supported by the hinge part 33, the pivotal devices 40 and the guide mechanism 50, for opening and closing operations, and as the cover unit 30 is moved from the closed position to the open position, the rear cover 32 moves rearward while lowering its front end. As a result, when the cover unit 30 is open, the front cover 31 covers the vicinity of the front end of the topboard 9 and the area below and in front of the topboard 9 in place of the rear cover 32.

Further, in the present embodiment, the front cover 31 is configured to have the loudspeakers 34 built therein. To this end, the upper wall 31*a* of the front cover 31 and the lower wall 31*c* of the front cover 31 are connected by the connecting members 31*e* in a manner spaced from each other to define an accommodation space. The loudspeakers 34 are fixed to a mounting plate 31*i* joined to the lower wall 31*c*, by screws or the like. The loudspeakers 34 are connected to a musical tone generator means, not shown, by connection wires, not shown, within the casing 2 for sounding tones together with the main loudspeakers 13 according to operations of keys and operators. Each loudspeaker 34 has a diaphragm opposed to the lower wall 31*c*, and therefore when the cover unit 30 is opened, sound is radiated toward the player. The diaphragm of each loudspeaker 34, however, does not necessarily have to be disposed in facing relation to the lower wall 31*c*, but it may be faced toward the upper wall 31*a*, for example. In this case, sound is radiated after reflection from the upper wall 31*a* toward the lower wall 31*c*, i e. toward the player via the space within the front cover 31. Within the front cover 31, not only the loudspeakers, but also various functional components, such as switches and controllers for musical tone control, and a liquid crystal display are operatably mounted on the panel surface (lower wall 31*c*). Broken lines 31*m* and 31*n* appearing in FIGS. 1 and 2 indicate respective connection wires from the liquid crystal display 31*k* and the loudspeakers 34 as functional components. As is apparent from FIG. 2, the connection wires 31*m* and 31*n* are laid between the stoppers 61 and 62 such that they are positioned in front of the hinge part 33 when the cover unit 30 is open.

Since the front cover 31 has the functional components built therein, it has a larger thickness than the conventional covers. Therefore, to prevent the front cover 31 from protruding toward the player by the increase in thickness to cause degradation in design and function, it is preferred that the front cover 31 can be turned into the open position after a sufficient rearward motion thereof. To this end, the hinge part 33 is preferably positioned below the pivotal device 40 serving as the pivot when the cover unit 30 is open. This is particularly effective in the case where when the cover unit 30 is in the open position, the rear cover 32 is sloped rearward with a large gradient or positioned substantially horizontally with respect to the front cover 31 which is then in a substantially horizontal position. The cover unit 30 is configured such that when it is closed, the front cover 31 and the rear cover 32 are substantially linearly aligned with a slight upward curve in side view, whereas when it is opened, the front cover 31 is brought into a position close to the rear cover 32, after a rearward pivotal motion.

Further, in the present embodiment, there is provided a damper mechanism 70 appearing in FIG. 1, for slowing down the opening and closing operations of the cover unit 30. The damper mechanism 70 is comprised of engaging parts 71 extending from the opposite lateral side edges of a rear part of the front cover 31 in the key arrangement direction, and resilient members 72, such as tension coil springs, each having one end thereof engaged with the associated engaging part 71, and the other end thereof engaged with a pin 73 provided on the keybed 5. These members are arranged such that the amount of extension of each resilient member 72 is large when the cover unit 30 is in the open and closed positions, and small when the cover unit 30 is in an intermediate position between the open and the closed positions. FIG. 1 shows the resilient member 72 in a state where the cover unit 30 is in the closed position, while FIG. 2 shows the resilient member 72 in a state where the cover unit 30 is in the open position. Further, in FIG. 3, the positions of the resilient member 72 taken when the cover unit 30 is in the open and closed positions are indicated by phantom lines, and the position of the resilient member 72 in the state where the cover unit 30 is in the intermediate position is indicated by broken lines. As illustrated in these figures, large resilient forces of the resilient members 72 act upon the cover unit 30 when the cover unit 30 is fully open or closed, so that the cover unit 30 receives larger resilient forces acting against the cover unit 30 as it approaches its open or closed position. This prevents the cover unit 30 from being abruptly brought into the open or closed position by its own gravity, whereby a danger that the player may have his/her finger caught between the cover unit 30 and keyboard 101 or the instrument body casing 2 can be avoided. The damper mechanism plays a significant role particularly in the case where the weight of the fallboard i.e. the cover unit 30 is increased due to accommodation of the functional components, such as the loudspeakers 34, in the front cover 31.

Preferably, the resilient force of each resilient member 72, which is utilized for achieving the damper function for slowing down the opening and closing operations of the cover unit 30, is controlled to act more strongly when the cover unit 30 is being closed. When the damper function is thus caused to act more strongly during closing of the cover unit 30, the amount of extension of the resilient member 72 is asymmetrical i.e. not equal between when the cover unit 30 is opened and when the cover unit 30 is closed. Alternatively, the damper function of the pivotal device 40 may be adjusted such that the damper function is caused to act more strongly during closing of the cover unit 30. In this case, the amount of extension of the resilient member 72 may be symmetrical i.e. equal between closing of the cover unit 30 and opening of the cover unit 30. More specifically, the position of the resilient member 72 during the opening of the cover unit 30 and that during the closing of the cover unit 30 are generally line-symmetrical as shown in FIG. 3, and the resilient member 72 has approximately the same amount of extension in the two positions.

The engaging members, such as the pins 73, for supporting the resilient members 72 can be disposed on the lateral side panels 8 or some other parts of the instrument body directly or via other members, instead of being disposed on the keybed 5 as shown in FIG. 3.

Although in the present embodiment, each pivotal device 40 including the pivotal support member 41 is disposed on the instrument body casing 2(lateral side panel 8), this is not limitative, but a pivotal device having the same construction as that of the pivotal device 40 may be fixed as the pivot to the rear end part of the front cover 31, and a mounting plate similar to the pivotal member may be fixed to the instrument body casing 2.

Further, the cover unit 30 may be constructed such that when it is closed, the front cover 31 and the rear cover 32 are substantially linearly aligned in side view, with at least the rear cover 32 of the two covers 31 and 32 being formed to have a generally upward curved construction, the cover unit 30 extends substantially linearly in side view from the location above the keyboard 101 to the topboard 9, and at least the rear cover 32 of the two covers 31 and 32 is formed to have a generally upwardly curved surface, whereby it is possible to reduce the overall height of the electronic keyboard instrument.

As described above, according to the present embodiment, the part of the electronic keyboard instrument from the keyboard 101 to the topboard 9 or the vicinity of the topboard 9 is covered by the cover unit 30 comprised of the front cover 31 and the rear cover 32. Therefore, the form of the range from the keyboard 101 to the topboard 9 or the vicinity of the topboard 9 can be freely determined by the front cover 31 and the rear cover 32. Further, it is possible to construct the cover unit 30 curved surface, and when it is opened, the front cover 31 is brought into a position close to the rear cover 32, after a rearward pivotal motion. According to this such that as the cover unit 30 is moved from the closed position to the open position, the rear cover 32 moves rearward, and when the cover unit 30 is fully open, the front cover 31 covers the vicinity of the front end of the topboard 9 and the area below and in front of the topboard 9 in place of the rear cover 32. In this case, irrespective of the form of the range from the keyboard 101 to the topboard 9 or the vicinity of the topboard 9, the front cover 31 in the open position covers the vicinity of the front end of the topboard 9 and the area below and in front of the topboard 9 in place of the rear cover 32, and therefore the front cover 31 cannot largely project upward from the topboard 9. Therefore, it is possible to obtain an excellent design without being restricted by the presence of a front panel fixed in the raised position. Further, since the topboard 9 can be disposed at a location that is below the front end of the front cover 31 in the open position, it is possible to reduce the height of the whole instrument.

Furthermore, according to the present embodiment, the electrically wired functional components are mounted in the front cover 31 such that the functional components face toward the player when the cover unit 30 is open, and therefore no space has to be provided for accommodating functional components necessary for the electronic keyboard instrument between the keyboard 101 and the topboard 9, which makes it possible to reduce the length of the musical instrument in the longitudinal direction thereof as well as to protect the functional components when they are not in use. Moreover, according to this construction, when the topboard 9 is removed, and then the rear cover 32 is pivotally moved forward, a part behind the front cover 31 becomes wide open. Therefore, when the electrically-wired functional components need checking or adjustment during manufacturing or maintenance, it is possible to check or adjust the electrical wiring easily through the open part. In general, a fallboard (cover unit 30 in the present embodiment) having functional components mounted therein has an increased thickness. However, according to the construction of the electronic keyboard instrument of the present embodiment, even when the cover unit 30 is opened, the cover unit 30 does not project forward by an amount corresponding to its thickness, or a receiving space corresponding to the thickness is not needed at the rear of the cover unit 30. This is because the front cover 31 and the rear cover 32 are pivotally connected together at the opposed ends of their upper walls by the hinge part 33, and the front cover 31 is pivotally supported at the rear end thereof below the hinge part 33 by pivotal support members (pivotal devices 40 and associated parts thereof) fixed to the instrument body. More specifically, even if the fallboard has an increased thickness, when the cover unit is opened, the front cover 31 turns while pivotally moving its upper wall from the closed position rearward about the pivotal support members, and the rear cover 32 also moves rearward in unison with the movement of the front cover 31. Therefore, to fully open the cover unit 30, a rearward shift of the front cover 31 corresponding to the thickness thereof is required. However, since the rear cover 32 moves rearward in unison with the movement of the front cover 31, the receiving space corresponding to the thickness of the front cover 31 is not needed. The upper wall of the front cover 31 in the closed position moves rearward when the cover unit 30 is opened, as described above, and therefore the front cover 31 does not project forward by an amount corresponding to the thickness thereof.

Further, according to the present embodiment, the loudspeakers 34 are contained in the front cover 31, so that when the cover unit 30 is closed, the loudspeakers 34 are covered by the front cover 31 from above. Therefore, it is possible to solve a problem brought about when loudspeakers mounted on a fixed part of the instrument body in a face-up state are covered e.g. by nets of cloth, i.e. the problem that dust having entered through the net deposits on the diaphragm and vibrating parts, causes not only an unsanitary state of the loudspeakers but also malfunctioning of the loudspeakers.

Next, a second embodiment of the present invention will be described with reference to FIGS. 5 and 6.

An electronic musical instrument according to the present embodiment is also implemented by an electronic keyboard instrument, such as an electronic piano or an electronic organ. FIG. 5 shows a state where a front cover is closed, and FIG. 6 shows a state where the front cover is open. In the electronic keyboard instrument 1' shown in FIGS. 5 and 6, an instrument body casing 2 is comprised of a keybed 5, a keyslip 6, a rear panel 7, lateral side panels 8, and a topboard 9, all of which are the same as those in the first embodiment. In the present embodiment, however, the front cover 12 as one part of a cover unit 20 functions as a fallboard (fallboard unit) for covering a keyboard (white keys 3 and black keys 4), and a rear cover 11 as the other part of the cover unit 20 extends rearward such that it upwardly slopes from the rear end of the front cover 12 and functions as a front panel for covering the player-side surface of the instrument body. Further, a short hanging board 10 extends downward from the front end of the topboard 9.

In the electronic keyboard instrument 1', loudspeakers 514 as functional components are accommodated in the front cover 12 such that the sound emitting surfaces of the loudspeakers 514 face toward the player when the front cover 12 is open. The loudspeakers 514 are connected to a musical tone controller, not shown, within the casing 2 by connection wires, not shown, to generate sound together with internal loudspeakers, not shown, or external loudspeakers, not shown, according to operations of keys and operators.

Figure 12A:
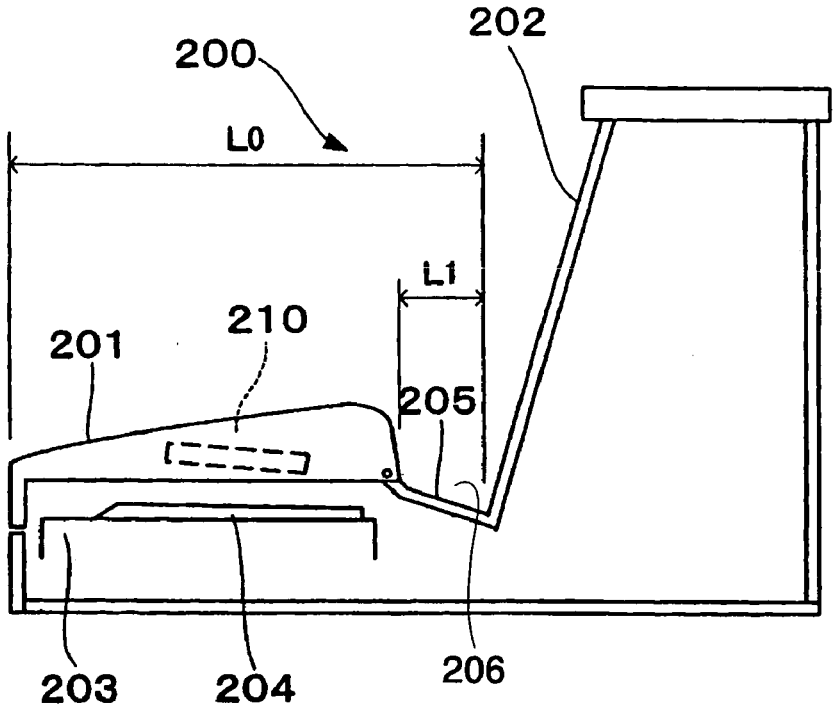
FIG. 12A PRIOR ART
Figure 12B:
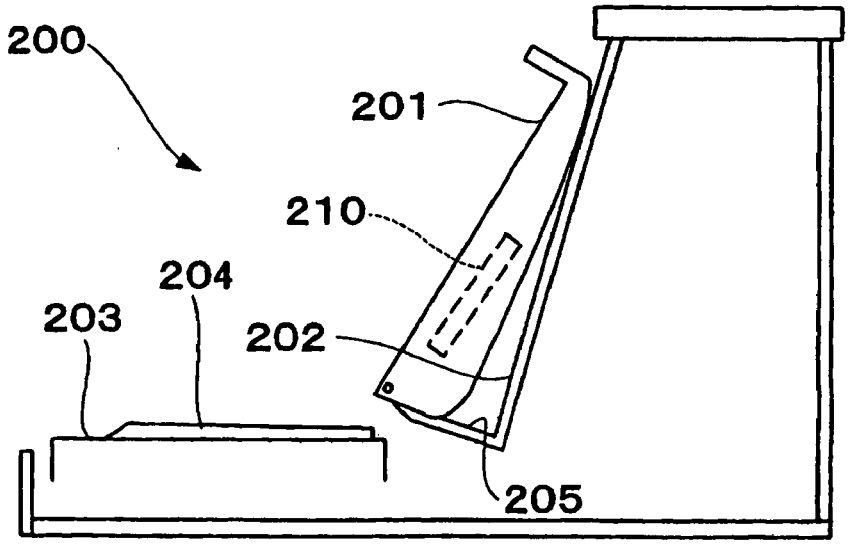
FIG. 12B PRIOR ART

In many conventional electronic keyboard instruments, the rear end of the fallboard is supported by a shaft secured to the instrument body, and the fallboard is turned about the shaft to be opened or closed. Therefore, to mount loudspeakers in the fallboard, the fallboard is constructed e.g. as shown in FIGS. 12A and 12B. FIG. 12A shows a conventional keyboard instrument 200 with a fallboard 201 closed. Reference numeral 203 designates white keys, and 204 black keys. FIG. 12B shows the keyboard instrument 200 with the fallboard 201 open. As shown in FIG. 12B, the fallboard 201 is supported in an almost upright position by a front panel 202. The loudspeakers 210 faces toward the player in this state, so that the player can hear musical tones directly from the loudspeakers 210.

However, with the construction described above, the fallboard 201 is inevitably formed to have a sufficient thickness for receiving the loudspeakers 210. Consequently, when the fallboard 201 is in the closed position, the thickness thereof becomes conspicuous, spoiling the appearance of the keyboard instrument 200. Further, a horizontal part 205 on which the fallboard 201 rests when the fallboard 201 is opened into the raised position is provided between the fallboard 201 and the front panel 202, so that the dimension of the depth, i.e. the distance L0 between the front end of the fallboard 201 and the front panel 202 is increased by the length L1 of the horizontal part 205, which spoils the appearance of the keyboard instrument 200. Furthermore, a step or recess 206 of a size corresponding to the thickness of the fallboard 201 is formed between the fallboard 201 and the front panel 202, and therefore, when an object happens to drop into the step or recess, it is hard to take out the object therefrom.

On the other hand, in a keyboard instrument of a type in which the fallboard 201, when opened into the raised position, is received between opposite lateral side panels, it is necessary to dispose the front panel 202 at a location largely retreated rearward from the front ends of the lateral side panels so as to receive the thick fallboard 201. As a result, when the fallboard 201 is closed, large steps appear between the front end faces of the lateral side panels and the front panel 202, which spoils the appearance of the keyboard instrument.

When functional components other than the loudspeakers 210 are built into the fallboard 201, causing an increased thickness of the fallboard 201, a similar problem occurs. Therefore, there is a demand for an electronic keyboard instrument having a construction which is free from the problem of an increased depth of the electronic keyboard instrument even when functional components, such as the loudspeakers 210, are built into the fallboard 201.

The cover unit 20 shown in FIG. 5 has a mounting structure described below. The rear cover 11 is disposed to cover the player-side face of the instrument body. Link members 16 are pivotally supported by respective pivots 15 fixed to the opposite lateral side panels 8, for supporting the rear cover 11. The rear cover 11 has opposite lateral side edges of the rear end thereof pivotally connected to the free ends of the link members 16 by respective pins 17. These members 15, 16, and 17 constitute a guide mechanism.

In the present embodiment, the pins 17 as connecting members connecting between the link members 16 and the rear end of the rear cover 11 are disposed at respective locations above the pivots 15 for the link members 16. This arrangement enables the rear end of the rear cover 11 to be located at a high location close to the topboard 9, which is advantageous in securing a receiving space for the rear cover 11 and improving the appearance of the electronic keyboard instrument 1'. However, the pins 17 can also be disposed at respective locations below the pivots 15 for the link members 16.

The front end of the rear cover 11 is pivotally connected to the rear end of the front cover 12 by a hinge member 18. The hinge member 18 extends continuously between the opposite lateral side edges of the front cover 12 and the rear cover 11. The front cover 12 has a sufficient thickness for receiving the loudspeakers 514. The hinge member 18 is attached to the front cover 12 at a rear upper end thereof when the front cover 2 is in the closed position, and the opposite lateral side edges of the rear lower ends of the front cover 12 are supported by the lateral side panels 8 via pins 21 as pivots, respectively, such that the front cover 12 can perform a pivotal motion (the pins 21 may be fixed to the lateral side panels 8 directly or via other members).

As described above, the rear cover 11, the link members 16, a part of the rear end of the front cover 12 in the thickness direction thereof, and the casing (lateral side panels 8), which supports the pivots 15 for the link members 16 and the pins 21 of the front cover 12, are linked to one another to form a four-joint pivotal linkage. With this linkage, as the front cover 12 is moved from the closed position to the open position, the rear cover 11 moves rearward and at the same time the front cover 12 is brought into a raised position in front of the rear cover 11 to cover the vicinity of the front end of the topboard 9 and an area below and in front of the topboard 9 in place of the rear cover 11. In short, the link members 16 function as guide members for guiding the rear end of the rear cover 11 as the rear cover 11 moves.

When the front cover 12 is open, it is supported by the hanging board 10 in a state tilted rearward (see FIG. 6), and in this state, the loudspeakers 514 direct their sound-radiating surfaces toward the player. The front cover 12 has parts formed of nets e.g. of cloth or a porous material covering the loudspeakers 514 so as not to block sound radiation from the loudspeakers 514. This enables the player to hear musical tones directly from the loudspeakers 514 simultaneously with output of musical tones from loudspeakers, not shown, disposed in the rear of the instrument body or outside the instrument body. Thus, musical tones can be heard accurately.

With this fallboard mounting structure, as the front cover 12 is moves downward into a horizontal position, the whole rear cover 11 moves upward. In other words, when the front cover 12 is closed, a range of pivotal motion exists in which downward shift of the center of gravity of the front cover 12 and upward shift of the center of gravity of the rear cover 11 cancel each other out to reduce acceleration of the lowering motion of the front cover 12.

Figure 5:
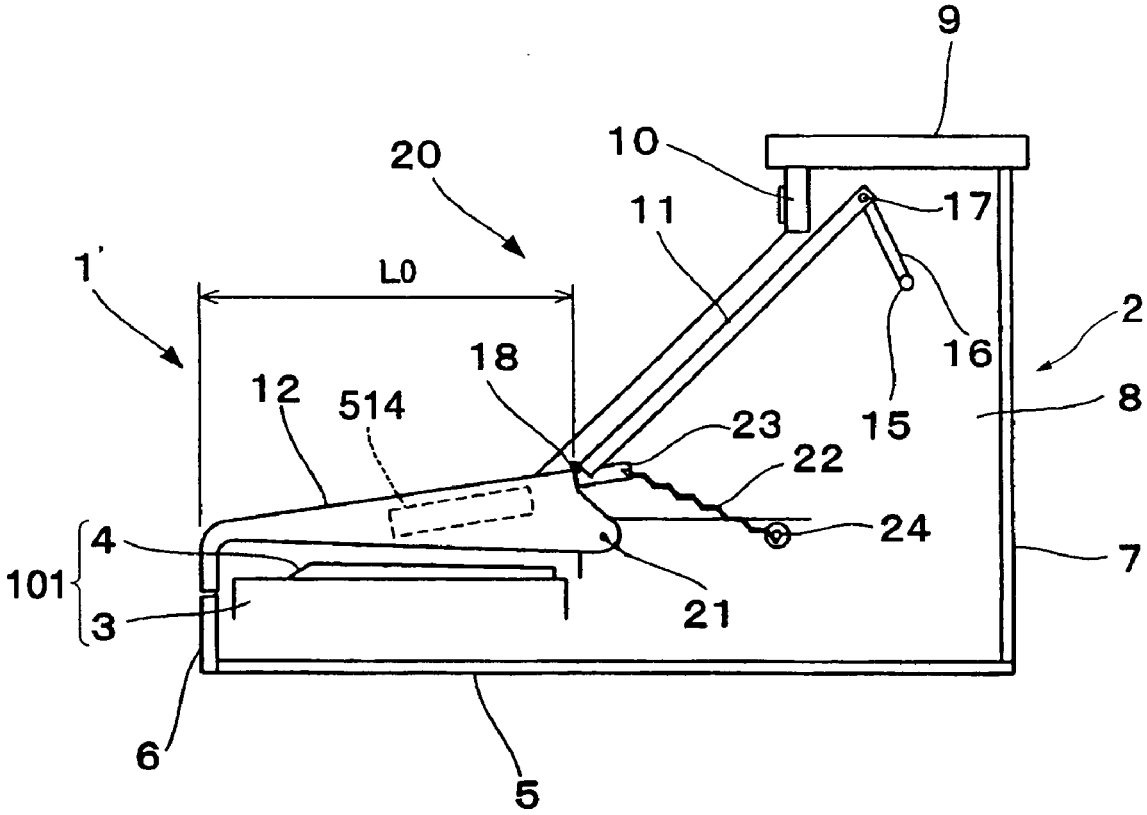
FIG. 5 is a longitudinal cross-sectional view of an electronic keyboard instrument as an electronic musical instrument according to a second embodiment of the present invention, in a state where a cover unit is closed.
Figure 6:
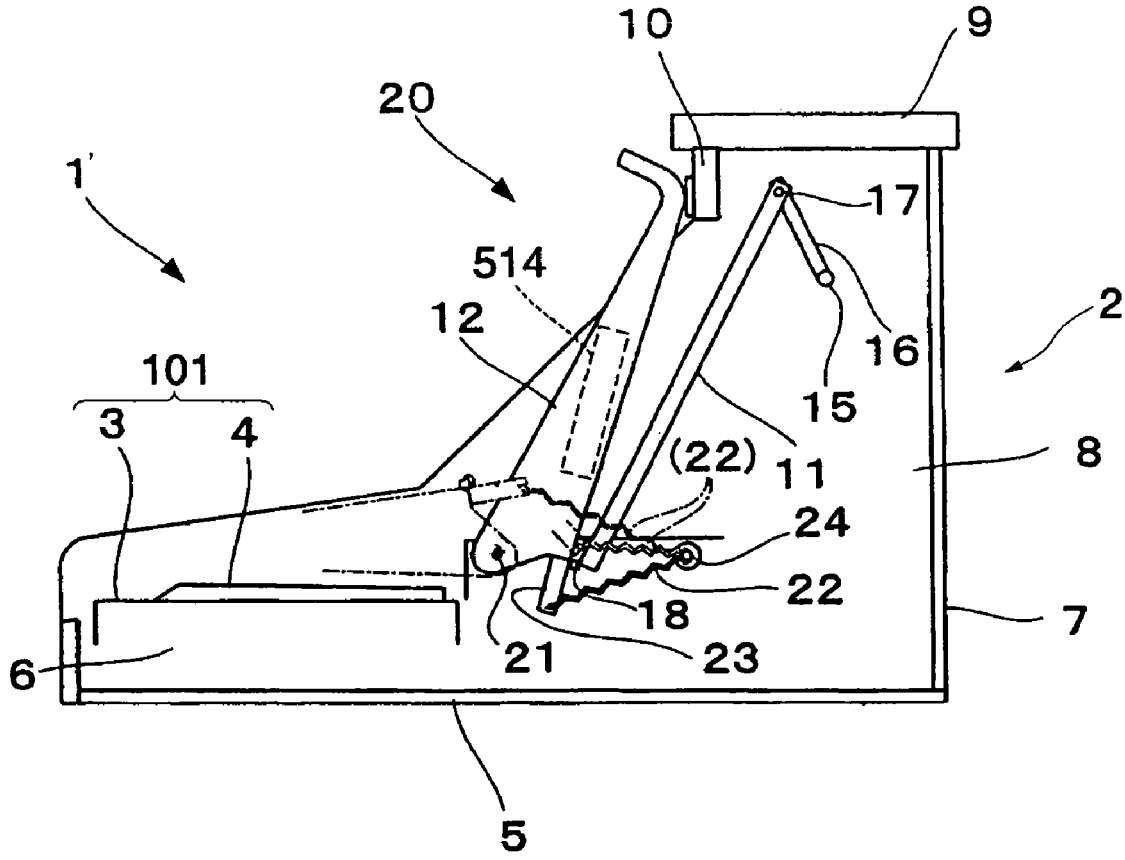
FIG. 6 is a longitudinal cross-sectional view of the electronic keyboard instrument shown in FIG. 5, in a state where the cover unit is open.

Further, a damper mechanism, as shown in FIGS. 5 and 6, may be provided for slowing down the opening and closing operations of the front cover 12. The damper mechanism is comprised of engaging parts 23 extending from the opposite lateral side edges of a rear part of the front cover 12 in the key arrangement direction, and resilient members 22, such as coil springs, each having one end thereof engaged with the associated engaging part 23, and the other end thereof engaged with a pin 24 on the associated lateral side panel 8. The pin 24 is located such that the amount of extension of the resilient member 22 is made asymmetrical, i.e. not equal between when the cover unit 20 is in the intermediate position and when it is in the open or closed position. More specifically, these members forming the damper mechanism are arranged such that the amount of extension of each resilient member 22 is large when the front cover 12 is in the open position and the closed position, and small when the front cover 12 is in the intermediate position between the open position and the closed position. FIG. 5 shows the resilient member 22 in a state where the front cover 12 is in the closed position. In FIG. 6, the position of the resilient member 22 taken when the front cover 12 is in the open position is indicated by solid lines, and the positions of the resilient member 22 taken when the front cover 12 is in the closed position and in the intermediate position are indicated by one-dot chain lines. As illustrated in these figures, large resilient forces of the resilient members 22 act upon the cover unit 20 when the front cover 12 is fully open or closed, so that the front cover 12 receives larger resilient forces acting against the front cover 12 as it approaches its open or closed position. This prevents the front cover 12 from being abruptly brought into the open or closed position by its own gravity, as in the first embodiment, whereby a danger that the player may have his/her finger caught between the front cover 12 and the keyboard or instrument body can be avoided. The engaging members, such as the pins 24, supporting the resilient members 22 can be disposed on the keybed 5 or some other parts of the instrument body directly or via other members, instead of being disposed on the lateral side panels 8 as shown in FIGS. 5 and 6.

As described above, according to the present embodiment, the link members 16 function as guide members for guiding the rear end of the rear cover 11, but the component elements needed for the function of the guide members are operated by each other's pivotal motion, so that no sliding friction which can be produced when sliding motion is involved in the guiding operation can be produced. This is advantageous in achieving smooth opening and closing operations of the cover unit 20.

Further, according to the present embodiment, since the damper mechanism including the resilient members 22 are provided, the force necessary for supporting the free end of the front cover 12 can be made more uniform over the entire range of pivotal motion of the front cover 12, and especially, it is possible to avoid a marked increase in the force necessary for supporting the front cover when the cover unit 20 approaches its fully open or closed position. In particular, the front cover 12 equipped with functional components are often designed to have an increased weight, which increases the force necessary for supporting the front cover 12 when the cover unit 20 approaches its fully open or closed position. Therefore, the damper mechanism including the resilient members 22 is very advantageous.

Next, a description will be given of a third embodiment of the present invention. An electronic musical instrument of the present embodiment is also implemented by an electronic keyboard instrument, such as an electronic piano or an electronic organ. As described in detail below, the present electronic keyboard instrument has a music rack device disposed on a topboard such that the music rack device can move rearward in the longitudinal direction of the topboard in unison with the opening and closing operations of a cover unit. With this arrangement, the music rack device can move in the direction of the depth of the topboard, so that even when a music stand is not in use, the music rack device can be received within the topboard in the longitudinal direction thereof.

The electronic keyboard instrument further includes a linkage means that links between the cover unit and the music rack device. The linkage means is disposed such that it can move via the linkage means in unison with the opening and closing operations of the cover unit to cause the music rack device to slide rearward in the longitudinal direction of the topboard when the cover unit is opened, and to slide forward in the longitudinal direction of the topboard when the cover unit is closed. This linkage means ensures interlocking between the motion of the cover unit and that of the music rack device.

Further, the linkage means is configured such that when at least a part of the cover unit moves rearward in the longitudinal direction of the topboard during the opening and closing operations of the cover unit, the linkage means functions such that a motion corresponding not to the whole distance over which the cover unit (or part of the cover unit) moves but to only part of the distance is transmitted to the music rack device. This considerably increases the degree of freedom in designing the length of the music rack device in the longitudinal direction and the depth of the topboard.

Furthermore, in the electronic keyboard instrument of the present embodiment, the substantial effective length of the music rack device in the longitudinal direction is configured to be larger than the depth of the topboard. More specifically, the length of the music rack device, i.e. the height of the music stand is increased from that of a conventional one to a dimension larger than the depth (approximately 250 mm) of a standard-sized topboard. As a result, the stability of a music book or paper set on the music rack device is increased. More specifically, the substantial effective length of the music rack device in the longitudinal direction is preferably equal to approximately 300 mm.

From another point of view, in the electronic keyboard instrument of the present embodiment, the depth of the topboard is preferably shorter than the substantial effective length of the music rack device in the longitudinal direction. More specifically, assuming that the music rack device has a conventionally ordinary length (approximately 150 mm to 200 mm), the topboard should be designed to have a smaller depth than a conventionally required depth. This makes it possible to make the whole electronic keyboard instrument compact in size.

In the present embodiment, the music rack device may be comprised of a music rack and a music shelf which are formed separately from each other, or have a music shelf formed integrally with a music rack. The "substantial effective length of the music rack device in the longitudinal direction" of the above music rack device is intended to mean the length of the music rack device measured in the longitudinal direction of the topboard with the music rack folded flat.

Hereafter, the electronic keyboard instrument including a linkage structure associated with the music rack device will be described with reference to FIGS. 7 to 10.

Figure 7:
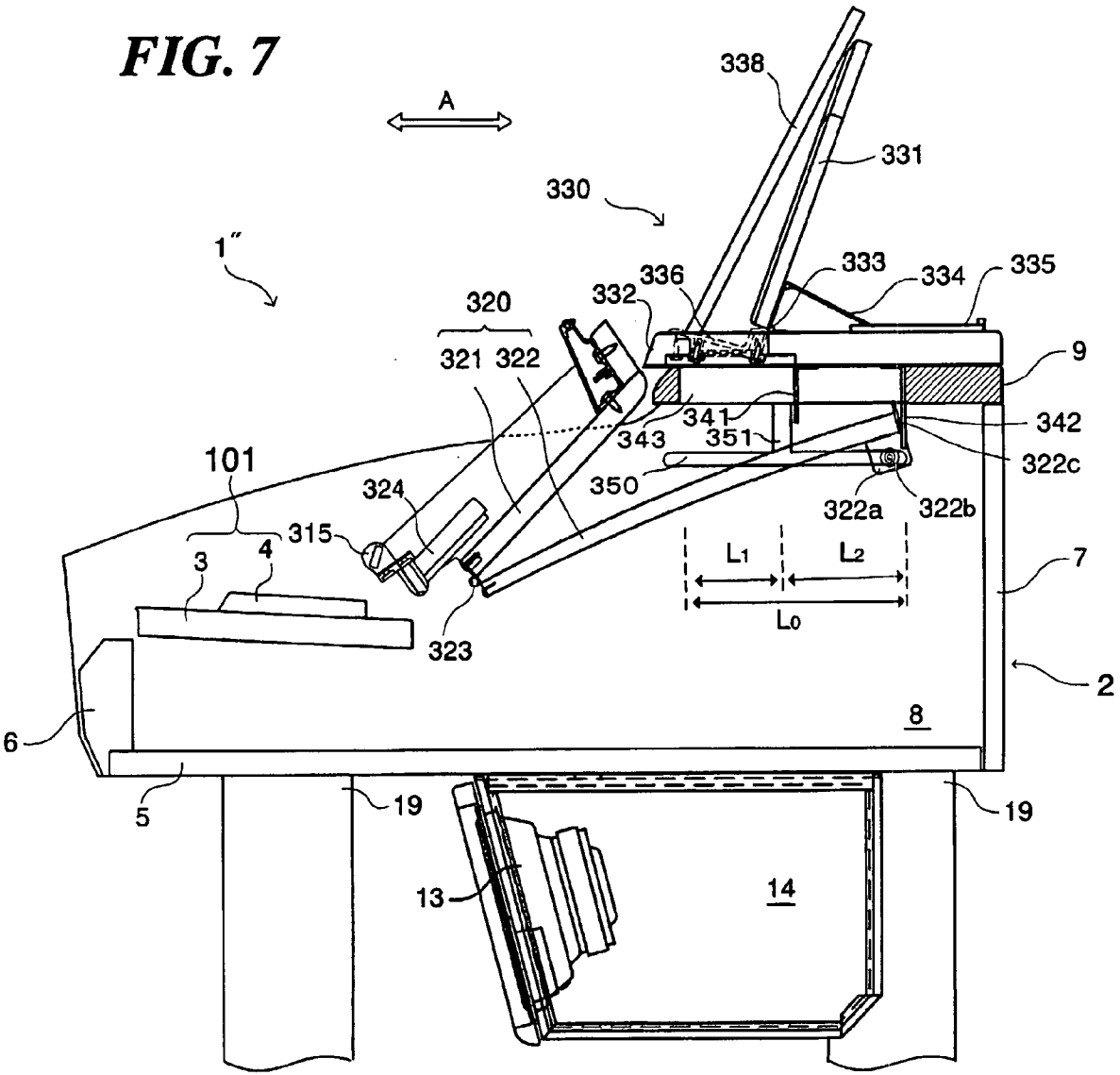
FIG. 7 is a longitudinal cross-sectional view of an electronic keyboard instrument as an electronic musical instrument according to a third embodiment of the present invention, in a state where a cover unit is open.
Figure 8:
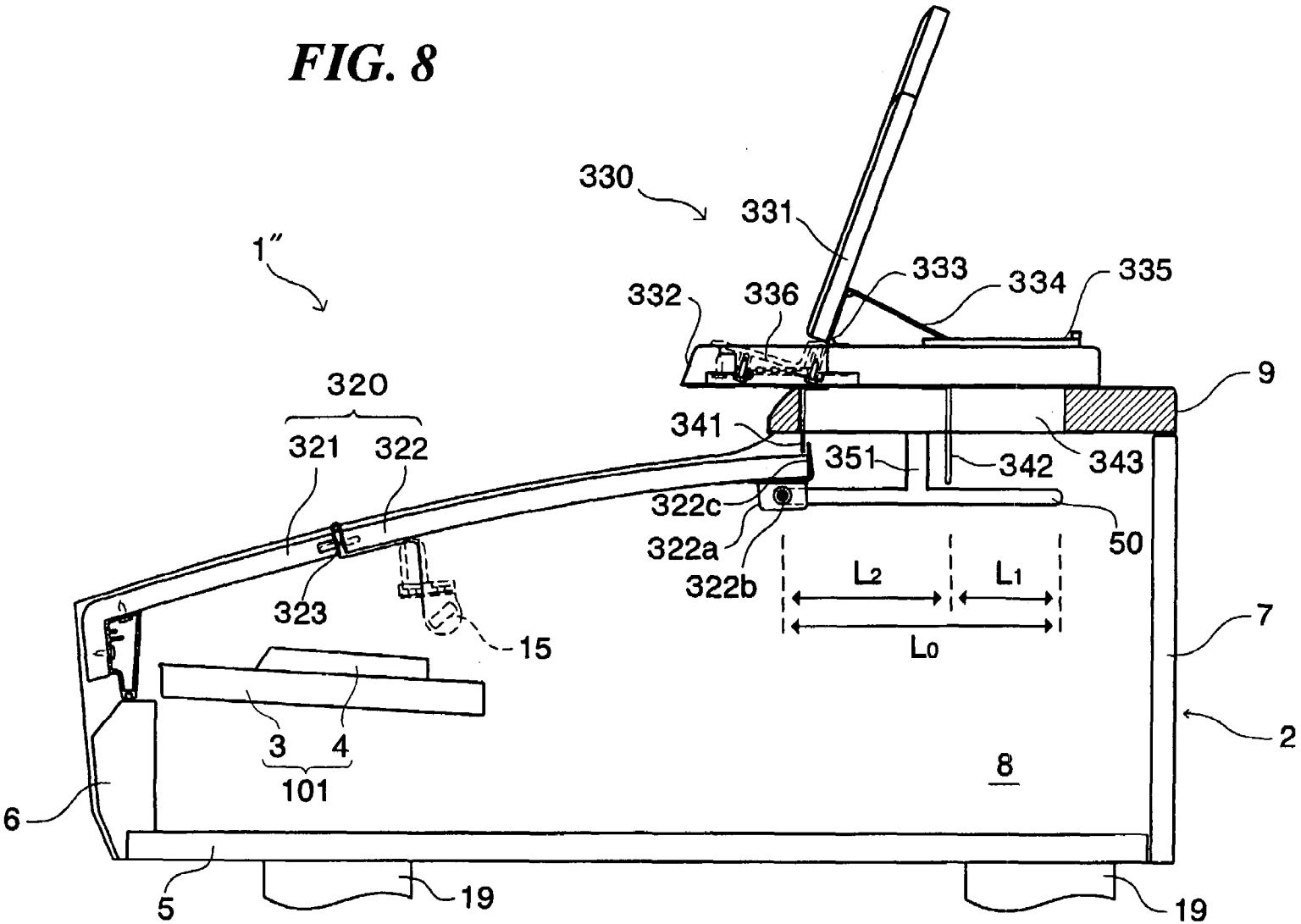
FIG. 8 is a longitudinal cross-sectional view of the electronic keyboard instrument in FIG. 7, in a state where the cover unit is closed.

FIG. 7 shows the electronic keyboard instrument 1" in a state where a cover unit 320 is open and a music rack 331 is raised, and FIG. 8 shows a state where the cover unit 320 is closed.

In the electronic keyboard instrument 1" shown in FIG. 8, the cover unit 320 covers a keyboard 101 and an area behind the keyboard 101 and serves as a fallboard. The cover unit 320 is comprised of a front cover (fallboard front section) 321 and a rear cover (fallboard rear section) 322 which are foldably connected to each other. The cover unit 320 covers an area extending over the keyboard 101 from the upper end of a keyslip 6 to the front end of a topboard 9 when it is in a closed position with the front cover 321 and the rear cover 322 being unfolded, and opens an area above the keyboard when it is in an open position with the front cover 321 and the rear cover 322 being folded.

The cover unit 320 is constructed and disposed as described below. That is, the front cover 321 as a part of the cover unit 320 is supported by pivots 315 fixed to left and right lateral side panels 8. The front cover 321 is pivotally moved about the pivots 315 to be opened and closed. When the front cover 321 is closed, it covers white keys 3 and black keys 4. The rear end of the front cover 321 and the front end of the rear cover 322 are pivotally connected by a hinge part 323. The front cover 321 has a sufficient thickness for receiving functional components, such as loudspeakers 324.

On the upper surface of the topboard 9, the music rack device 330 is disposed in a manner slidable in the forward and rearward directions (longitudinal direction) (i.e. directions indicated by a double-headed arrow A in FIG. 7). The music rack device 330 is comprised of a music rack 331 and a slide board 332, and the music rack 331 is pivotally supported on the slide board 332 by a rotary shaft 333 mounted on the lower end of the rear surface of the music rack 331. The music rack 331 is supported from behind by a support member 334. The support member 334 is engaged with an engaging part 335 at a predetermined position thereof, whereby the music rack 331 is held in a raised and slightly rearwardly tilted position. The slide board 332 is formed therein with a recess open upward, and a music shelf 336 is received in the recess and extends continuously in a transverse direction parallel with the rotary shaft 333. When a music book 338 is placed standing on the raised music rack 331, the lower end of the music book 338 is supported by the music shelf 336.

The music rack device 330 slides on the topboard 9 in the forward and rearward directions in unison with the opening and closing operations of the cover unit 320. The slide board 332 has a front tongue 341 and a rear tongue 342 fixed to an underside surface thereof in a manner spaced from each other in the forward and rearward directions and extending substantially perpendicularly downward from the slide board 332 through a groove-like opening 343 formed through the topboard 9. As the front tongue 341 and the rear tongue 342 move along the opening 343, the slide board 332 slides on the topboard 9 in the forward and rearward directions.

Each of the lateral side panels 8 is formed therein with a guide groove 350. When the cover unit 320 is opened, left and right engaging pins 322*b* projecting from connecting parts 322*a* fixed to the rear end of the rear cover 322 slide along the respective associated guide grooves 350, to allow rearward sliding motion of the rear cover 322. Each lateral side panel 8 is also formed therein with an introducing groove 351 for introducing the engaging pin 322*b* from the upper end of the lateral side panel 8 to the guide groove 350.

When the rear cover 322 slides forward, an engaging hook 322*c* projecting from the connecting part 322*a* engages with the front tongue 341 to drag the front tongue 341 forward, while when the rear cover 322 slides rearward, the engaging hook 322*c* pushes the rear tongue 342 rearward. This construction enables the music rack device 330 to slide on the topboard 9 in the forward and rearward directions in unison with the opening and closing operations of the cover unit 320.

In the present embodiment, the engaging hook 322*c*, the front tongue 341, and the rear tongue 342 act as the linkage means for transmitting the motion of the cover unit 320 to the music rack device 330. This construction is given only by way of example, and therefore, it is to be understood that the concept of the linkage means includes any different construction that can enable the same action as above.

Next, the operation of the linkage means for moving the music rack device 330 forward and rearward in unison with the opening and closing operations of the cover unit 320 will be described in detail with reference to FIGS. 7 and 8. In FIG. 8, elements which are not involved in the motion of the cover unit 320 and the music rack device 330 are omitted.

Figure 9:
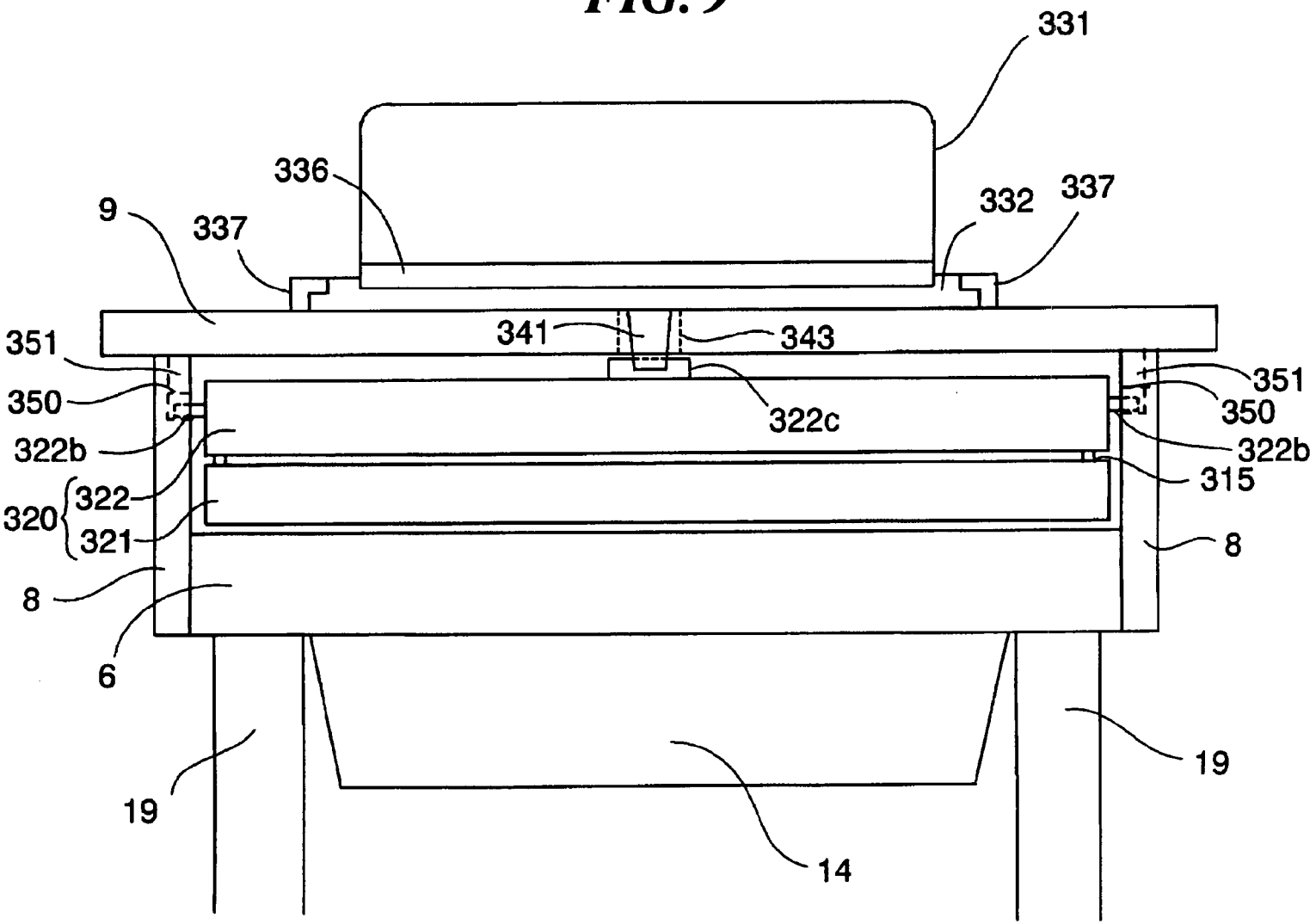
FIG. 9 is a front view of the electronic keyboard instrument in FIG. 7, in the state where the cover unit is closed.

In FIG. 7, the electronic keyboard instrument 1" is shown with the cover unit 320 open, as mentioned above. In this state, the rear end of the rear cover 322 is held in contact with the rear tongue 342 fixed to the slide board 332. As the cover unit 320 is closed, the rear end of the rear cover 322 moves away from the rear tongue 342, and the rear cover 322 moves forward along the guide grooves 350. After having moved forward along the guide grooves 350 over a predetermined distance (=L2), the rear end of the rear cover 322 comes into contact with the front tongue 341. Thereafter, as the cover unit 320 is further closed, the engaging hook 322*c* at the rear end of the rear cover 322 drags and moves the front tongue 341 forward. In accordance with this operation, the music rack device 330 slides forward (toward the player) on the upper surface of the topboard 9. When the cover unit 320 is fully closed, the rear end of the rear cover 322 has moved over a predetermined distance, and the front tongue 341 reaches the vicinity of the front end of the opening 343 and stops. In this state, the music rack device 330 is in a position projecting slightly forward of the upper surface of the topboard 9. FIG. 8 is a longitudinal cross-sectional view showing the electronic keyboard instrument 1" with the cover unit 320 thus fully closed, and FIG. 9 is a front view of the electronic keyboard instrument 1" in this state. As shown in FIG. 9, the front tongue 341 (and the rear tongue 342) is located substantially at the center of the electronic keyboard instrument 1" in the transverse direction of the same. The upper and side surfaces of each of the opposite lateral side edges of the slide board 332 are held in contact with an associated one of left and right guide members 337 extending in the longitudinal direction of the electronic keyboard instrument 1", and the slide board 332 slides along the left and right guide members 337.

Next, a description will be given of the operation of the linkage means performed when the cover unit 320 of the electronic keyboard instrument 1" is moved from the closed position shown in FIG. 8 into the open position. When the operation for opening the cover unit 320 is started, the rear end of the rear cover 322 moves away from the front tongue 341 and moves along the guide grooves 350, and in unison with this motion, the engaging hook 322*c* slides rearward. The rear end of the rear cover 322 having moved along the guide grooves 350 over the predetermined distance (=L2) comes into contact with the rear tongue 342. Since the rear tongue 342 can move rearward along the opening 343, the rear tongue 342 is pushed by the rear end of the rear cover 322 to move over a predetermined distance (=L1) until each of the engaging pins 322*b* reaches the terminal end of the associated guide groove 350. When the engaging pins 322*b* reach the respective terminal ends of the guide grooves 350, the rear tongue 342 reaches the vicinity of the rear end of the opening 343.

As is apparent from the above description, in accordance with the opening and closing operations of the cover unit 320, the rear cover 322 slides over a substantial effective length (L0=L1+L2) of the guide groove 350 in the longitudinal direction. In doing this, the music rack device 330 which slides in unison with the opening and closing operations of the cover unit 320 slides forward or rearward over only the distance of L1. In other words, the sliding motion of the rear end of the rear cover 322 within the spacing (=L2) between the front tongue 341 and the rear tongue 342 does not influence the motion of the music rack device 330 in the forward and rearward directions. In short, the spacing (=L2) between the front tongue 341 and the rear tongue 342 serves to accommodate part of the distance over which the rear cover 322 moves for opening or closing the cover unit 320.

The distance (L1) over which the music rack device 330 slides can be easily adjusted by changing the positions of the front tongue 341 and the rear tongue 342 on the slide board 332, so that it is also easy to change the accommodated distance. The distance (=L0) over which the rear cover 322 slides can also be set as desired, by changing the length of the guide grooves 350 and that of the opening 343 as required. In the present embodiment, only part of the distance over which the cover unit 320 travels (i.e. the distance over which the rear cover 322 slides) can be converted to the sliding motion (distance) of the music rack device 330 as described above. This makes it possible to increase the degree of freedom in designing the length of the music rack device 330 in the longitudinal direction, the depth of the topboard 9, the sliding structure of the cover unit 320, etc.

Figure 10:
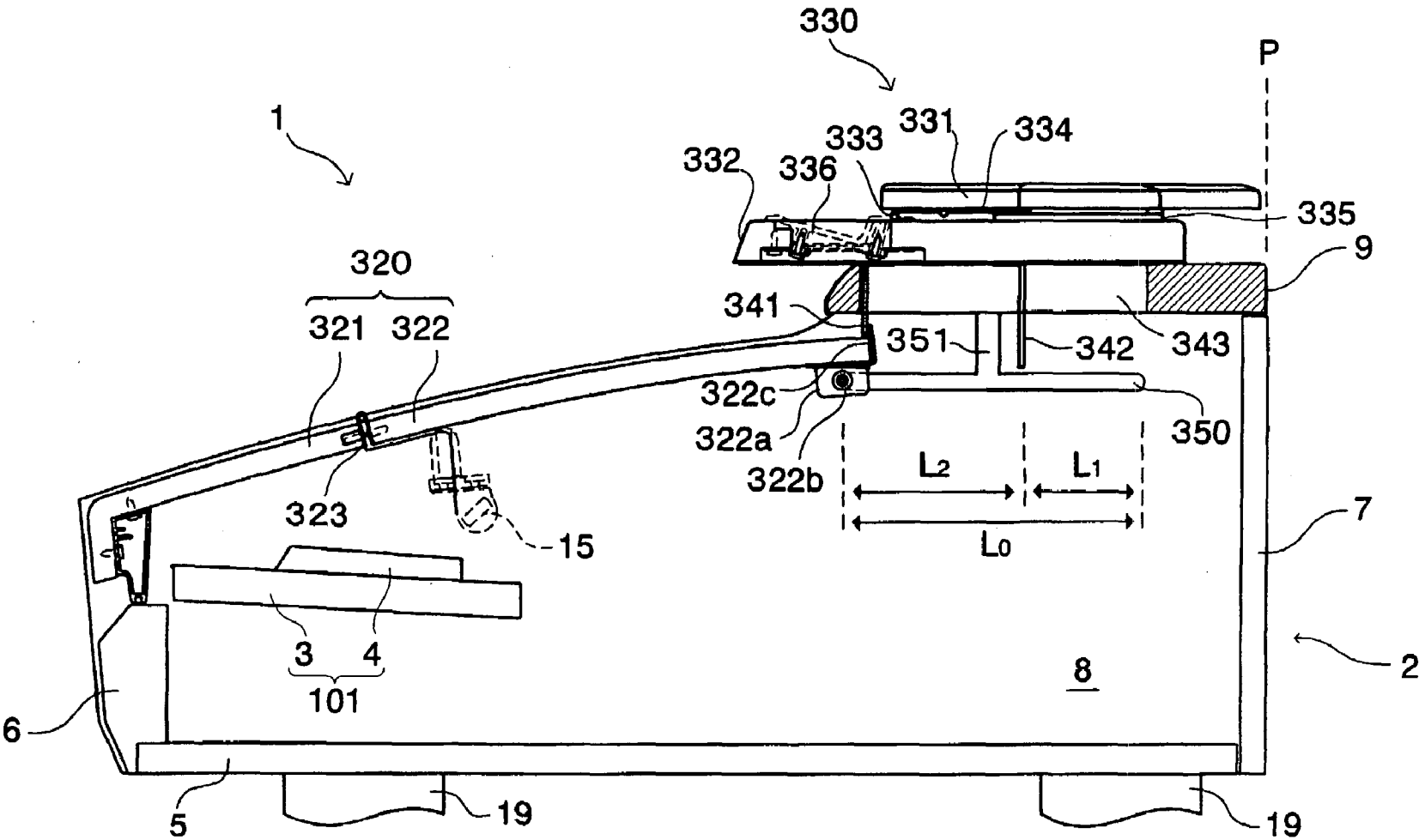
FIG. 10 is a longitudinal cross-sectional view of the electronic keyboard instrument in FIG. 7, in a state where the cover unit is closed and a music rack is folded flat.
Figure 11A:
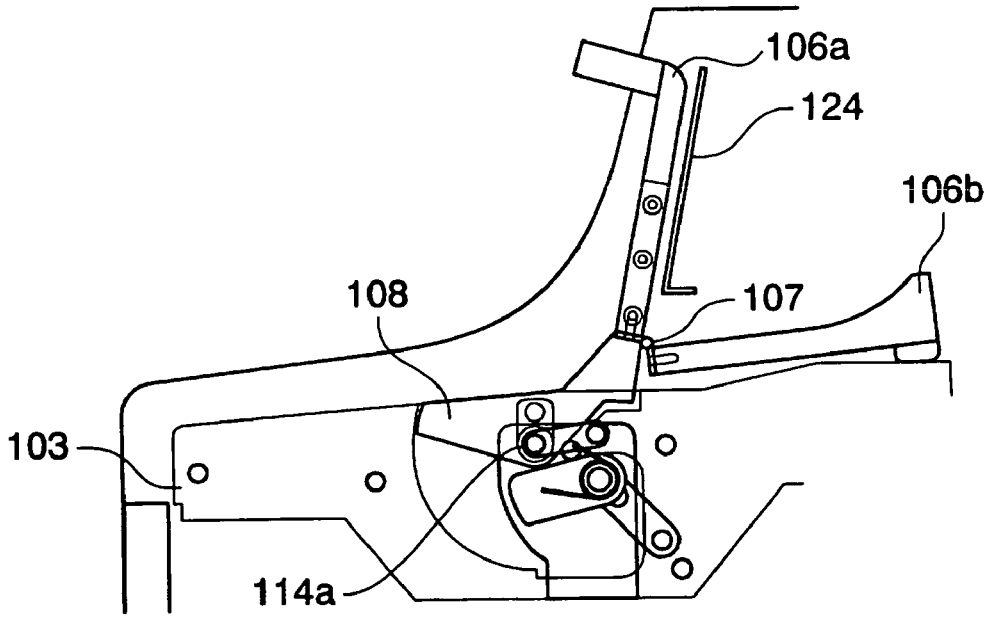
FIG. 11A PRIOR ART
Figure 11B:
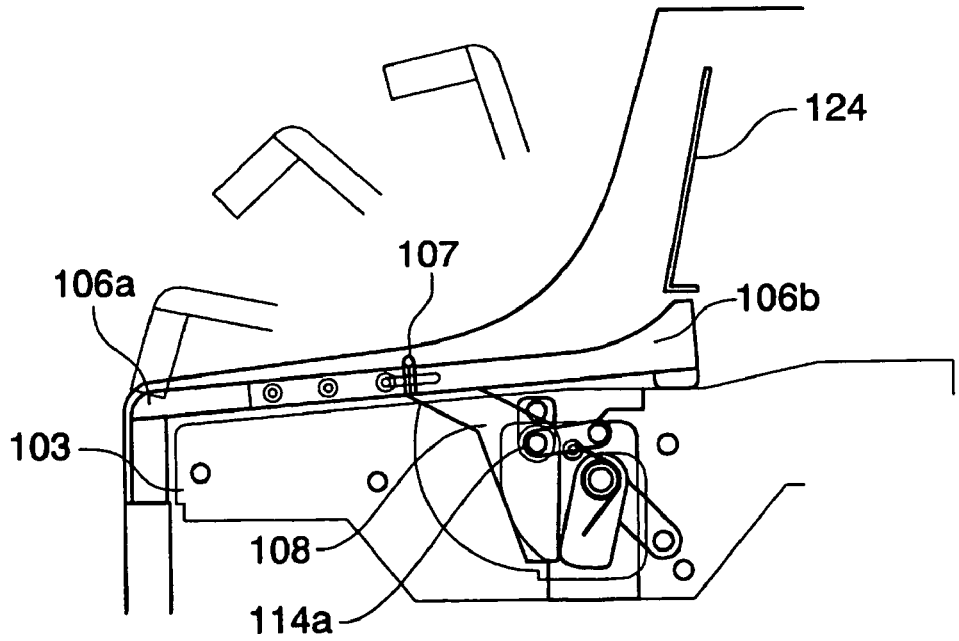
FIG. 11B PRIOR ART

FIG. 10 shows a state in which the music rack 331 is in a fallen or folded position with the cover unit 320 closed. The music rack 331 is designed such that when it is folded rearward, it does not extend rearward beyond the rear end (point P) of the topboard 9. It is preferable that the design of the depth of the topboard 9, the length of the music rack 331, and so forth are adjusted together with the spacing (=L1) between the front tongue 341 and the rear tongue 342 in the forward and rearward directions. This adjustment makes it possible not only to obtain a sufficient height of the music rack 331 for stably supporting a music book or paper, but also to make the electronic keyboard instrument 1" compact in size, i.e. reduced in depth.

Further, since the music rack device 330 projects forward of the front end of the topboard 9 when the cover unit 320 is in the closed position, it is easy for the player to use the music rack 331 or the slide board 332 of the music rack device 330 as a writing board when he/she writes in a music book or the like.

Furthermore, it is preferable that some space is defined between the front cover 321 and the slide board 332 when the cover unit 320 is open. This makes it possible to prevent the player's finger from being caught between the front cover 321 and the music rack device 330 when the player opens the cover unit 320.

The construction of the linkage means for linkage between the music rack device 330 and the cover unit 320 is not limited to the example illustrated in FIGS. 7 to 10. For example, gears or belts or a combination of gears and belts may be used to convert part of the distance over which the cover unit 320 moves to the distance over which the music rack device 330 slides. Further, although in the present embodiment, the front cover 321 of the cover unit 320 pivotally moves about the hinge 323, and the rear cover 322 moves forward and rearward, this is not limitative, but other parts of the cover unit 320 or the whole cover unit 320 may move forward and rearward.

As described above, according to the present embodiment, since the music rack device 30 is disposed on the topboard 9 such that it can be moved in the longitudinal direction of the topboard 9 in unison with the opening and closing operations of the cover unit 320, the music rack device 30 can be accommodated within the depth of the topboard 9 even when the music stand is not in use, which makes it possible to make the electronic keyboard instrument 1" reduced in depth.

Next, a fourth embodiment of the present invention will be described with reference to FIGS. 13 to 16.

Figure 13:
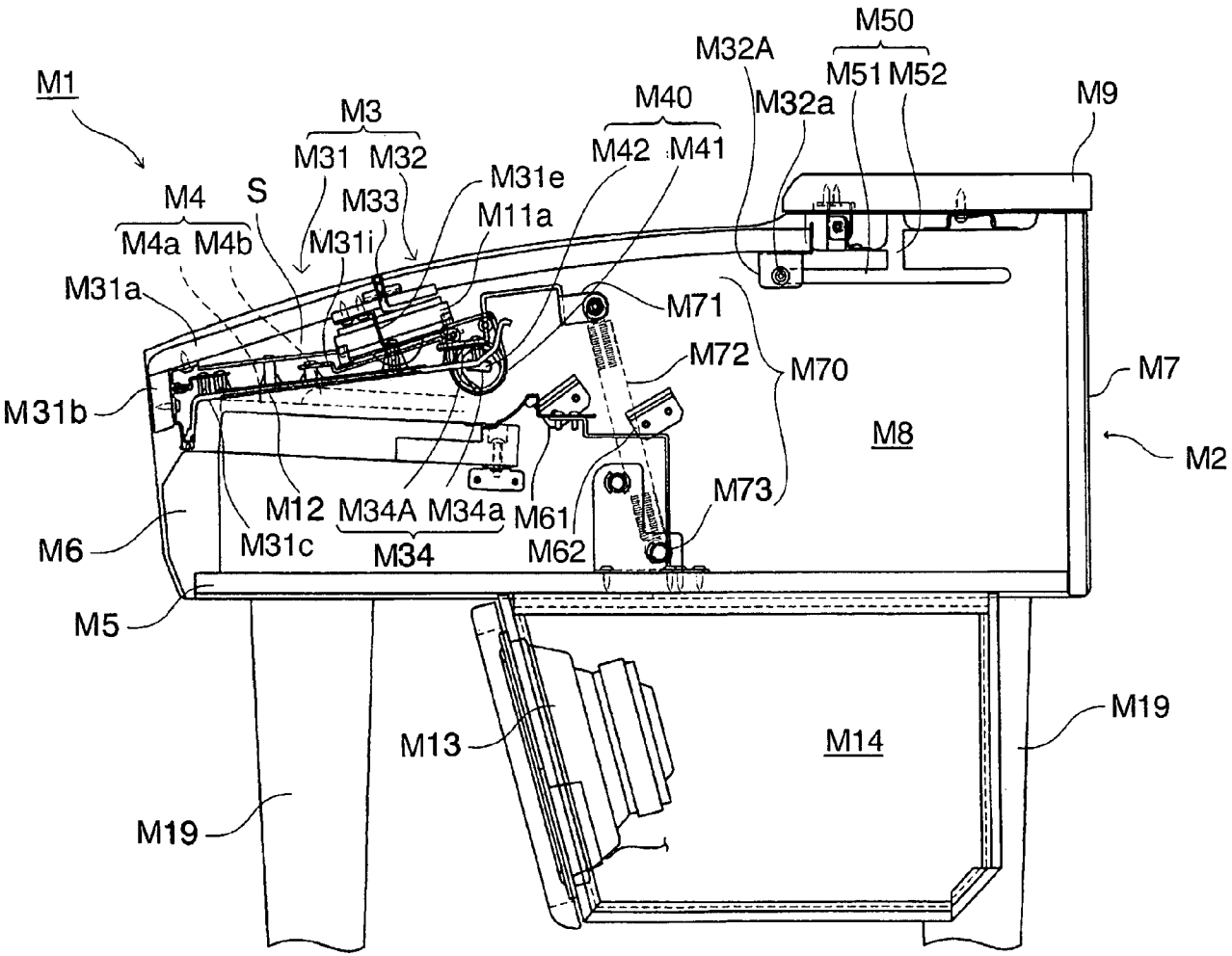
FIG. 13 is a longitudinal cross-sectional view of an electronic keyboard instrument as an electronic musical instrument according to a fourth embodiment of the present invention, in a state where a fallboard unit is closed.
Figure 14:
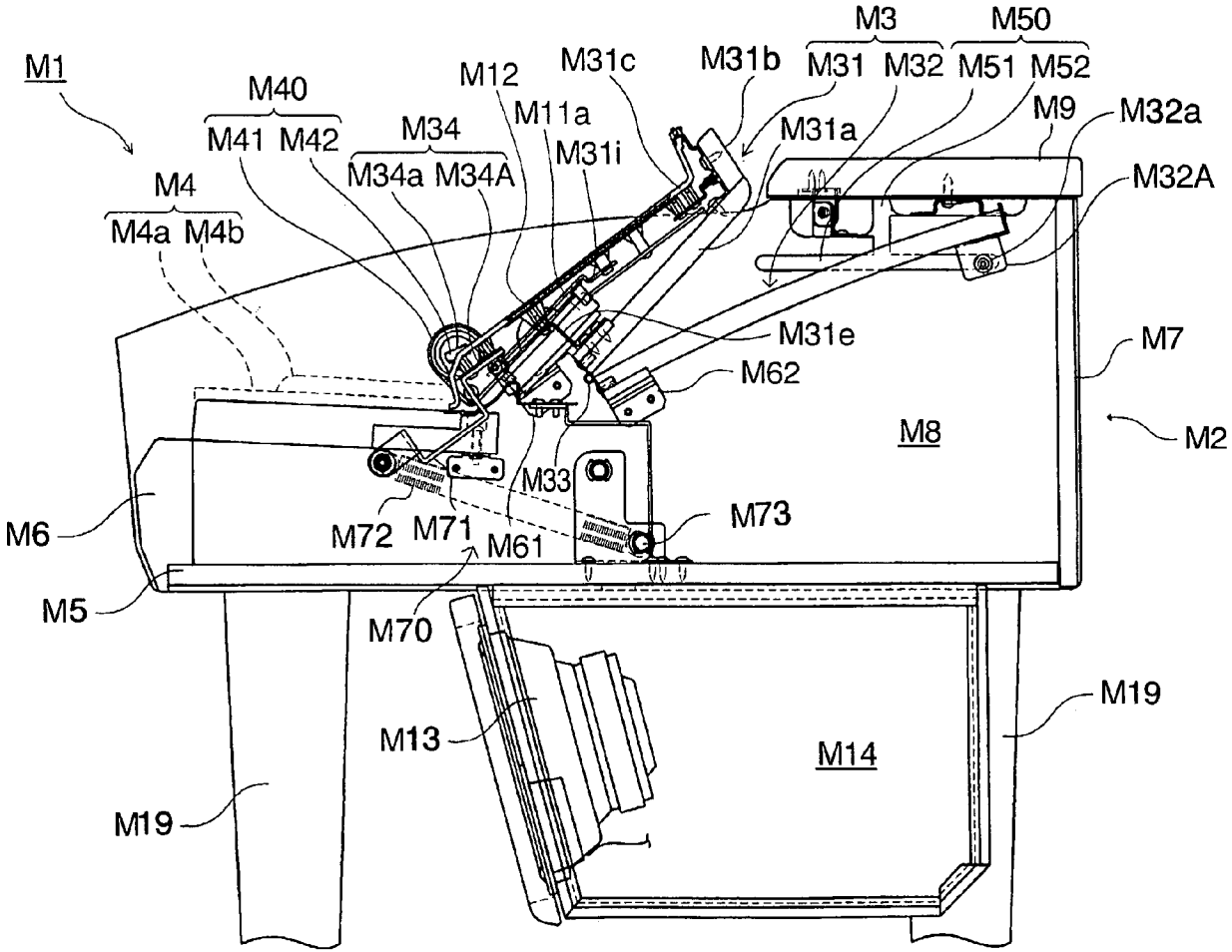
FIG. 14 is a longitudinal cross-sectional view of the electronic keyboard instrument shown in FIG. 13, in a state where the fallboard unit is open.
Figure 15:
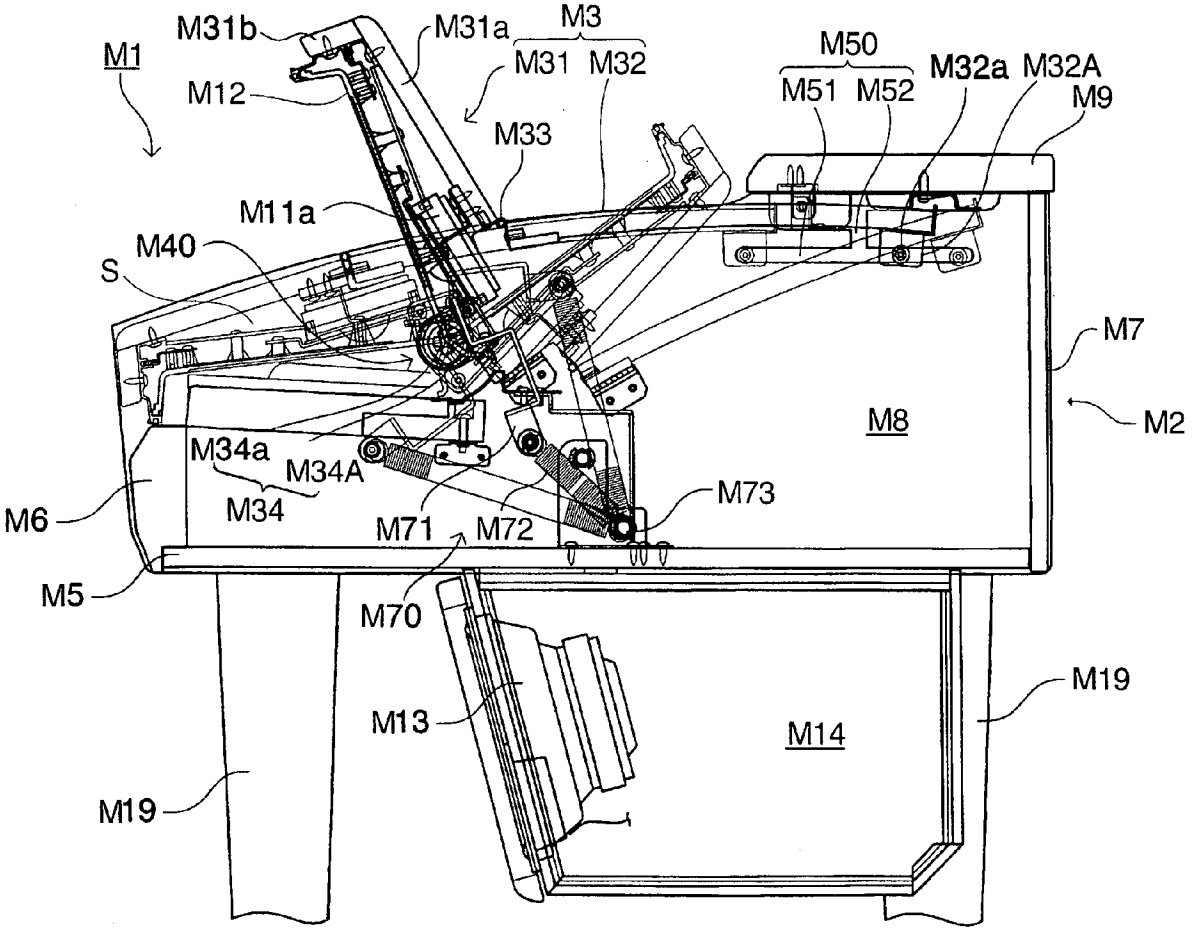
FIG. 15 is a longitudinal cross-sectional view of the electronic keyboard instrument shown in FIG. 13, in a state where the fallboard unit is in an intermediate position between a fully open position and a fully closed position.
Figure 16:
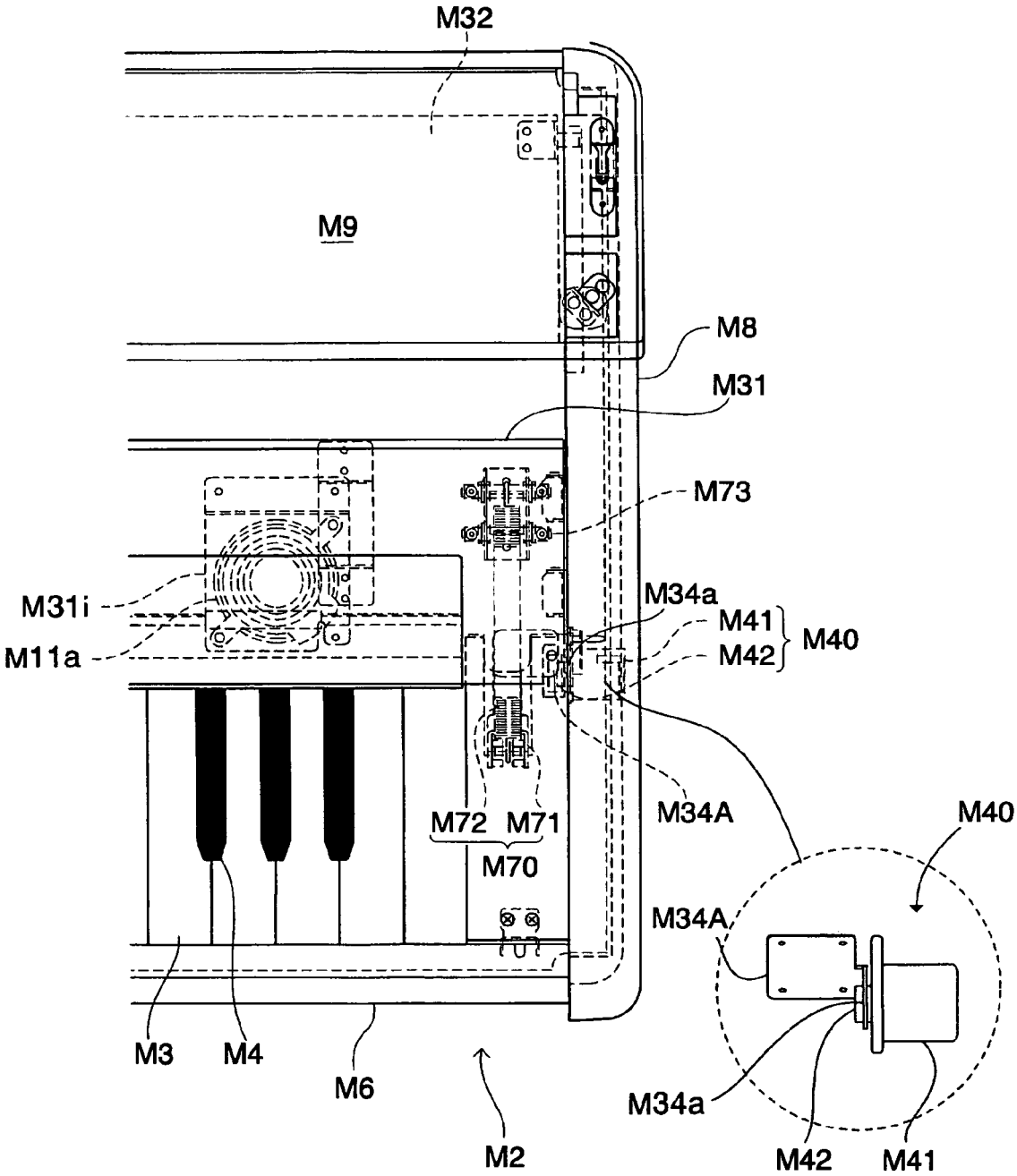
FIG. 16 is a fragmentary plan view showing a part of the electronic keyboard instrument shown in FIG. 13, in the state where the fallboard unit is open.

FIGS. 13 to 15 are longitudinal cross-sectional views of an electronic keyboard instrument as an electronic musical instrument of the present embodiment, in which FIG. 13 shows a state where a fallboard unit is closed, FIG. 14 shows a state where the fallboard unit is open, and FIG. 15 shows a state where the fallboard unit is in an intermediate state. FIG. 16 is a fragmentary enlarged view showing the fallboard unit in the open state i.e. in the open position.

As shown in FIGS. 13 to 15, the electronic keyboard instrument M1 is comprised of an instrument body M2 and the fallboard unit M3 disposed to cover an upper face of the instrument body M2. The instrument body M2 is generally box-shaped, and is comprised of a keyboard M4 (white keys M4*a*, black keys M4*b*) as performance operators, a keybed M5 forming the bottom of the instrument body M2, a keyslip M6 attached to the front end of the keybed M5, a rear panel M7, a pair of left and right lateral side panels M8, a topboard M9 covering an upper part of the instrument body M2, a loudspeaker box M14 accommodating main loudspeakers 13, and legs M19 extending downward from the keybed M5. Mounted within the instrument body M2 are a control unit for controlling musical tones, and switches or a controller for use in the musical tone control, a power supply unit, connection terminals, and so forth, none of which are shown. In the present invention, the term "performance operators"

represents not only a keyboard but also all other operators or operating elements, such as switches for musical tone control, but in the present embodiment, the "performance operator" is intended to mean only the keyboard M4.

The fallboard unit M3 functions as a cover member for covering the performance operators. The fallboard unit M3 is a fallboard assembly that is divided at an intermediate part thereof in the forward and rearward directions into a fallboard front section (first fallboard component, front cover) M31 and a fallboard rear section (second fallboard component, rear cover) M32. The fallboard unit M3 as the fallboard assembly is basically formed by the fallboard front section M31 and the fallboard rear section M32, and connecting members, functional components and a protective member, all referred to hereinafter, are built into the fallboard unit M3, as required. The fallboard front section M31 and the fallboard rear section M32 are connected by a hinge member (hinge part) M33 attached to outer surfaces of the respective sections M31 and M32, such that the sections M31 and M32 can be pivotally moved in respective directions in which the upper surfaces thereof become opposed to each other. The fallboard front section M31 has the upper wall M31*a* located on the upper side, as viewed in the closed position, and extending between the front end (free end) of the fallboard front section M31 and the hinge member M33, a front wall M31*b* extending perpendicularly downward from the front end of the upper wall M31*a*, and a lower wall M31*c* located on the lower side, as viewed in the closed position, and extending between the front end of the fallboard front section M31 and pivotal motion supports M34. The fallboard front section M31 extends in the transverse direction so as to cover the whole keyboard. A space S is defined between the upper wall M31*a* and the lower wall M31*c*, in which the functional components are arranged. The front wall M31*b* functions as a keyboard concealing part covering the front end of the keyboard M4 in the closed position. The distance between the upper wall M31*a* and the lower wall M31*c* is progressively reduced toward the front wall M31*b* from the hinge part M33 and the pivotal motion supports M34, and the front end of the fallboard front section M31 is smaller in thickness than parts thereof close to the hinge member M33 and the pivotal motion supports M34.

The pivotal motion supports M34 of the fallboard front section M31 are positioned inward, i.e. downward and rearward of the hinge member M33 when the fallboard unit M3 is closed. Each pivotal motion support M34 is formed by a mounting plate 34A as a pivotal member, which is formed therein with a fitting hole M34*a*. The instrument body M2 has pivotal devices M40 supporting the respective pivotal motion supports M34. As shown in FIG. 16, each of the pivotal devices M40 is comprised of a shaft M42 projecting from the associated lateral side panel M8, for pivotal motion, and a pivotal support member 41 embedded in the lateral side panel 8 and rotatably supporting the shaft M42. The shaft M42 is fitted in the fitting hole M34*a* of the associated pivotal motion support M34. In the pivotal device M40, when the shaft M42 turns within the pivotal support member M41, the turning motion of the shaft M42 undergoes a resistance force due to contact resistance of internal parts of the pivotal support member M41, whereby the turning motion of the shaft M42 is slowed down.

On the other hand, in the fallboard front section M31, the upper wall M31*a* and the lower wall M31*c* are connected to each other by connecting members M31*e*, in a manner spaced from each other to define a space S therebetween. The space S accommodates loudspeakers M11*a* as functional components M11, and a printed circuit board, not shown, for controlling operating element groups, not shown, such as an operating element group for setting musical tone parameters, an operating element group for an automatic control system, and an operating element group for performance assistance. More specifically, the distance between the upper wall M31*a* and the lower wall M31*c* increases toward the rearward side, and the above-mentioned functional components are arranged at respective locations rearward of the halfway point between the front end of the fallboard front section M31 and the hinge member M33. However, it is also possible to arrange the functional components at locations forward of the halfway point. In the rear end of the fallboard front section M31, the upper wall M31*a* and the lower wall M31*c* are spaced from each other by an amount corresponding to the spacing between the hinge member M33 and the pivotal motion support M34.

The loudspeakers M11*a* as functional components are fixed by screws or the like to mounting plates M31*i* joined to the lower wall M31*c*. Each loudspeaker M11*a* has a diaphragm, not shown, opposed to the lower wall M31*c*, and therefore, when the fallboard unit M3 is open, sound is radiated toward the player. Further, although not shown, the loudspeaker M11*a* is connected to the musical tone control unit within the instrument body M2 by connection wires to generate sound together with the internal loudspeakers M13 or external loudspeakers, not shown, in accordance with operations of keys and operating elements performed when the fallboard unit M3 is open. The diaphragm of each loudspeaker M11*a* does not necessarily have to face toward the lower wall M31*c*, but it may be disposed in facing relation to the upper wall M31*a*, for example. In this case, sound is radiated, after being reflected from the lower wall M31*c*, toward the lower wall M31*c*, i.e. toward the player via the space S within the fallboard front section M31.

The above-mentioned lower wall M31*c* has the protective member M12 provided on a side thereof which becomes opposed to the keyboard M4 when the fallboard unit M3 is closed. The protective member M12 is provided for protecting the functional components (e.g. the loudspeakers M11*a*) from external shock which can be applied when the fallboard unit M3 is open, and can be formed of a resin or metal plate. The functional components arranged in the space S within the fallboard front section M31 are protected by being secured to the protective member M12. The assembling efficiency can be enhanced by having the member M12 as a lower cover hold thereon all functional components, such as parameter-setting operating elements and a liquid crystal display, for setting tone colors, effects, automatic performance, and for performance assistance, electric component parts, key switches, loudspeakers, and various holders and a base plate for these, and then fixing the resulting sub-assembly to the upper wall M31*a* as a top cover.

At the rear of the fallboard rear section M32, there is provided a guide mechanism M50 for guiding the fallboard rear section M32 when it slides in the forward and rearward directions. The guide mechanism M50 has left and right guide means disposed slightly below the topboard M9 and associated with the respective lateral side panels M8. In the following, a description will be given of only one of the pair of guide means, as deemed appropriate. The guide means is comprised of a guide groove M51 extending substantially horizontally and an introducing groove M52 extending from the guide groove M51 to the upper end of the topboard M9. These grooves may be directly formed in the lateral side panel M8 or in a member attached to the lateral side panel M8. The fallboard rear section M32 has support plates M32A that are attached to the rear end thereof and have engaging pins M32*a* projecting therefrom. Each of the engaging pins M32*a* is introduced from the associated introducing groove M52 into the associated guide groove M51 so as to be slidably fitted therein.

The fallboard front section M31 is thus comprised of the two covers, i.e. the upper wall M31*a* as the top cover, and the lower wall M31*c* and the protective member M12 as the lower cover, as described above. The fallboard front section M31 has a sufficient thickness for receiving functional components, whereas the fallboard rear section M32 is formed to have a small thickness that does not allow reception of functional components.

Figure 19:
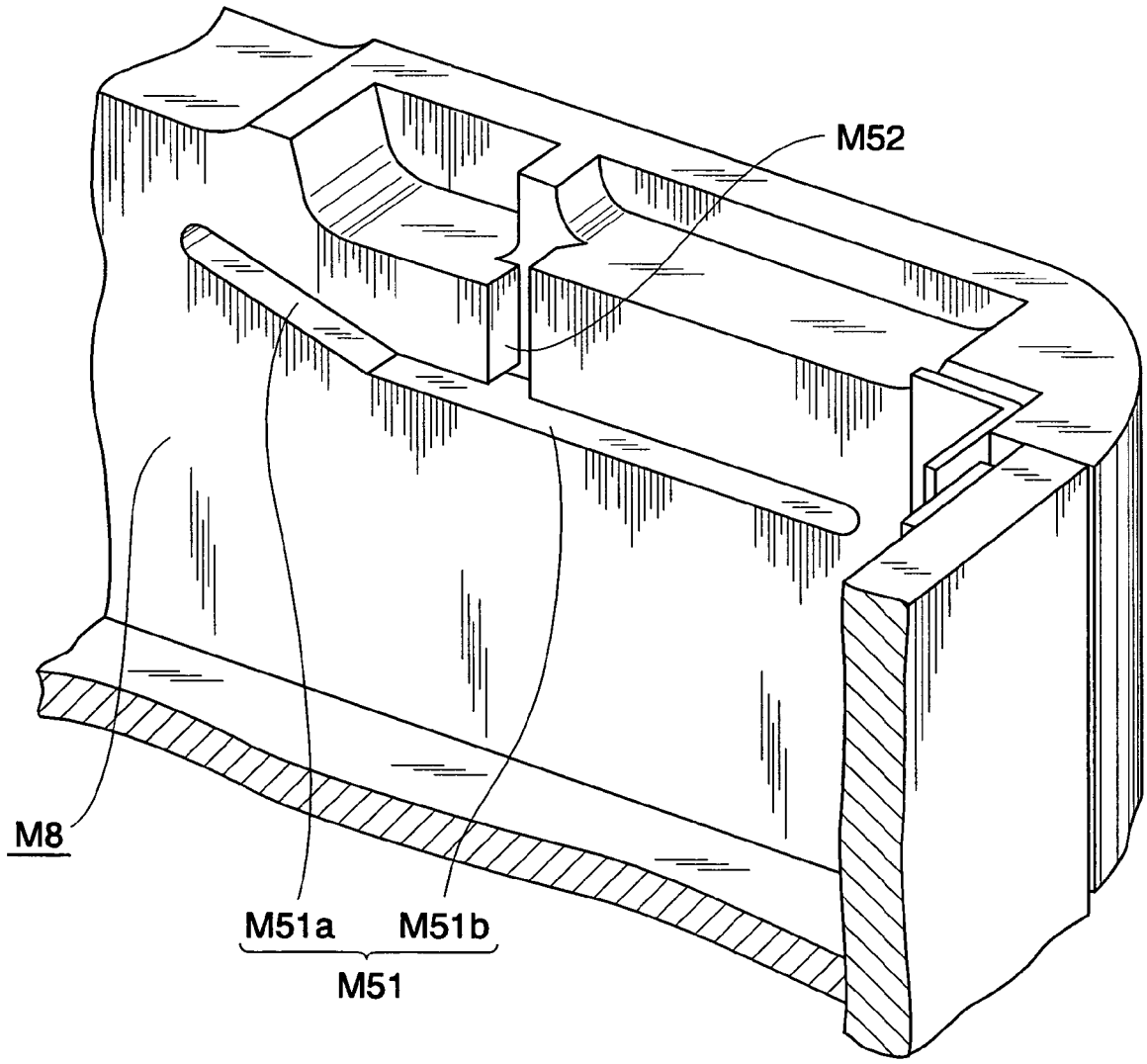
FIG. 19 is a side view showing an example of a guide mechanism of the electronic keyboard instrument shown in FIG. 13.

Alternatively to the above arrangement of the guide groove M51 and the engaging pin M32*a*, the guide grooves M51 may be formed in the fallboard rear section M32 and the engaging pins M32*a* may be provided on the lateral side panels M8. Further, the guide groove M51 may be shaped in the form of a desired one of various possible guide paths along which the motion of the fallboard rear section M32 can be guided via the engaging pin M32*a* as an engaging member. For example, if the guide path is linear, the range of motion of the fallboard rear section M32 is also linear. By thus configuring the guide path in a desired form, it is possible to streamline the operation of the fallboard rear section 32 and make the instrument body compact in size. Further, the guide groove M51 may be formed, as shown in FIG. 19, such that a front groove M51*a* thereof is sloped down rearward to a substantially horizontal rear groove M51*b*, so as to achieve easy sliding and opening operation of the fallboard rear section M32 without bringing the rear end thereof into abutment or contact with other members mounted below the topboard M9.

Further, the electronic keyboard instrument M1 according to the present embodiment is provided with a damper mechanism M70 disposed in the instrument body M2, for assisting the opening and closing operations of the fallboard unit M3. The damper mechanism M70 is comprised of engaging parts M71 extending from the opposite lateral side edges of a rear part of the fallboard front section M31, resilient members M72, such as tension coil springs, and pins M73 projecting from the keybed M5. Each of the resilient members M72 has one end thereof engaged with the associated engaging member M71, and the other end thereof engaged with the associated pin M73. The resilient member M72 is disposed such that the amount of extension thereof is large when the fallboard unit M3 is in the open position (see FIG. 14) and in the closed position (see FIG. 13), and small when the fallboard unit M3 is in an intermediate position (see FIG. 15) between the open position and the closed position. Further, provided within the instrument body M2 are provided stoppers M61 and M62 for stopping the fallboard front section M31 and the fallboard rear section M32, respectively, when the fallboard unit M3 is fully opened.

The opening and closing operations of the fallboard unit M3 of the electronic keyboard instrument M1 constructed as above will be described with reference to FIGS. 13 to 15. First, a description will be given of how the fallboard unit M3 is opened from the closed position. Referring first to FIG. 15, when the fallboard front section M31 is pivotally raised, it pivotally moves about the pivotal motion supports M34. At this time, the pivotal motion supports M34 are positioned below the hinge member M33, and hence the rear end of the fallboard front section M31 moves rearward, and in unison with this motion of the fallboard front section M31, the fallboard rear section M32 connected to the fallboard front section M31 via the hinge member M33 is pushed rearward. As a result, the engaging pins M32*a* attached to the fallboard rear section M32 slide rearward along the respective guide grooves M51, whereby the whole fallboard rear section M32 is moved rearward. During this process, the front end of the fallboard rear section M32 moves in accordance with the turning motion of the fallboard front section M31 such that the whole fallboard rear section M32 is sloped downward, as viewed from the rear end thereof. At the start of the opening operation of the fallboard front section M31, the resilient members M72 apply assisting tensile forces acting in the direction in which the fallboard front section M31 is raised, to the fallboard front section M31, so that it is possible to turn the fallboard front section M31 upward easily with a relatively small force.

When the fallboard unit M3 is fully opened, the upper wall M31*a* of the fallboard front section M31 and the upper wall of the fallboard rear section M32 comes into abutment with the respective stoppers M61 and M62 (see FIG. 14). Immediately before the fallboard unit M3 is fully opened, the resilient members M72 act to apply tensile forces acting in a direction opposite to the direction in which the fallboard unit M3 is opened, to the fallboard unit M3, which prevents the fallboard unit M3 from abruptly falling rearward due to its own weight. Further, when the fallboard unit M3 is fully opened, the engaging pins M32*a* of the fallboard rear section M32 reach the rear ends of the respective associated guide grooves M51.

As described above, when the fallboard unit M3 is open, the fallboard front section M31 and the fallboard rear section M32 are in respective retracted positions for laying open the keyboard M4, and the fallboard front section M31 covers the vicinity of the front end of the topboard M9 and an area below and in front of the topboard M9 in place of the fallboard rear section M32. Since the fallboard front section M31 has the pivotal motion supports M34 which are positioned below the hinge member M33 when the fallboard front section M31 is in the closed position, the fallboard front section M31 is received in a range below the topboard M9. Thus, when the fallboard unit M3 is open, the fallboard front section M31 reliably covers the vicinity of the front end of the topboard M9 and the area below and in front of the topboard M9, without projecting above the topboard M9.

On the other hand, when the fallboard unit M3 is open, the fallboard front section M31 is raised at a predetermined angle, with its lower wall M31 facing toward the player. At this time, the fallboard front section M31, which has its thickness progressively reduced toward the front end thereof, can be raised to a position largely tilted rearward in the longitudinal direction. It is preferable that the raised fallboard front section M31 has an inclination angle that allows the sound-emitting surface of the loudspeakers M11*a* to lie on a plane substantially perpendicular to the player's line of sight taken when the player looks at the fallboard front section M31. By so setting, the player can hear sound directly and accurately from the loudspeakers M11*a*. Further, in the case where the functional components include a display section composed of a liquid crystal display or the like, since the fallboard front section M31 in the raised position is significantly inclined toward a horizontal position, it is easy for the player to view contents displayed on the display section during performance. For the same reason, components, such as switches, as the functional components M11, also have improved operatability.

On the other hand, to close the fallboard unit M3, the fallboard front section M31 is drawn forward toward the player to cause a pivotal motion thereof about the pivotal support members M41. At this time, the engaging pins M32*a* of the fallboard rear section M32 slide forward along the respective guide grooves M51 to guide the fallboard rear section M32 forward. When the fallboard unit M3 is fully closed as well, the resilient members M72 act to apply assisting tensile forces to the fallboard front section M31 so as to prevent the fallboard front section M31 from being abruptly closed due to its own weight. When the fallboard unit M3 is completely closed, the electronic keyboard instrument M1 comes into the state shown in FIG. 13. In this closed position of the fallboard unit M3, since the fallboard front section M31 has its thickness progressively reduced toward the front end thereof, the following advantageous effects are provided: The reduced thickness of the front end of the fallboard front section M31 reduces the rotation moment during the opening operation, which makes it easy to raise the fallboard front section M31. Further, the front face of the electronic keyboard instrument M1 is reduced in height, which makes it possible to make the electronic keyboard instrument M1 compact in size and excellent in design.

As described hereinabove, according to the present embodiment, even in the case where the functional components M11, such as loudspeakers, are built in the fallboard front section M31 of the electronic keyboard instrument M1, the fallboard front section M31 can be received in a range below the topboard M9 when it is open, which can reduce the amount of rearward projection of the fallboard unit M3 when it is opened. This makes it possible to make the electronic keyboard instrument M1 reduced in depth. Further, since no unnecessary space is defined at the rear of the fallboard front section M31, the fallboard unit M3 can extend horizontally when it is in the closed position, which prevents the appearance of the electronic keyboard instrument M1 from being spoiled.

Further, since the instrument body is equipped with the damper function performed by the damper mechanism M70 and the pivotal devices M40, it is possible to easily open and close the fallboard unit M3 having the fallboard front section M31 which is heavier than the conventional one due to the functional components being provided therein, as well as to prevent the fallboard front section M31 from abruptly falling in the opening direction or in the closing direction due to its own weight.

In the present embodiment, the pivotal devices M40 also have a similar damper function to the damper function performed by the resilient members M72. More specifically, the pivotal devices M40 have the damper function of applying to the turning motion of the shafts M42 resistant forces generated by contact with the internal members of the pivotal support members M41 when the shafts M42 turn in the associated pivotal support members M41, and therefore the damper function of the pivotal devices M40 can be utilized to apply appropriate resistance to the turning motion of the fallboard front section M31. By causing this damper function to act more strongly when the fallboard front section M31 is closing or opening, it is possible to prevent the fallboard front section M31 from abruptly falling in the closing direction or in the opening direction due to its own weight. In the present embodiment, since the fallboard front section M31 has its thickness progressively reduced toward the front end thereof and therefore the weight of the fallboard unit M3 is reduced, even if the damper mechanism is small-sized, it can fully attain the goal of its function.

It is preferable that the damper function of the resilient members M72 or the pivotal devices M40 is caused to act more strongly during the closing of the fallboard unit M3. When the damper function is caused to act more strongly during the closing of the fallboard unit M3, the amount of extension of the resilient member M72 is asymmetrical i.e. not equal between when the fallboard unit M3 is opened and when the fallboard unit M3 is closed. Alternatively, the damper function of the pivotal devices 40 may be adjusted such that the damper function is caused to act more strongly during closing of the fallboard unit M3. In this case, the amount of extension of the resilient members M72 during closing of the fallboard unit M3 may be symmetrical i.e. equal to that during opening of the fallboard unit M3. More specifically, the position of the resilient member M72 during the cover opening operation and that during the cover closing operation are generally line-symmetrical as shown in FIG. 15, and the resilient member M72 has approximately the same amount of extension in the two positions.

The engaging members, such as the engaging pins M73, supporting the resilient members M72 can be disposed on the lateral side panels M8 or some other parts of the instrument body M2 directly or via other members, instead of being provided on the keybed 5 as shown in FIGS. 13 to 15.

Further, the fallboard unit M3 may be constructed such that when it is closed, the fallboard front section M31 and the fallboard rear section M32 are substantially linearly aligned in side view, with at least the fallboard rear section M32 of the two sections M31 and M32 being formed to have a generally substantially upwardly curved surface, and when it is open, the fallboard front section M31 is in a position close to the fallboard rear section M32, which is taken after a rearward pivotal motion thereof. According to this construction, the fallboard unit M3 extends substantially linearly in side view from the position above the keyboard M4 to the topboard M9, which makes it possible to reduce the overall height of the electronic keyboard instrument. As a result, the player can sit in front of the electronic keyboard instrument for performance without feeling oppressed.

Figure 17:
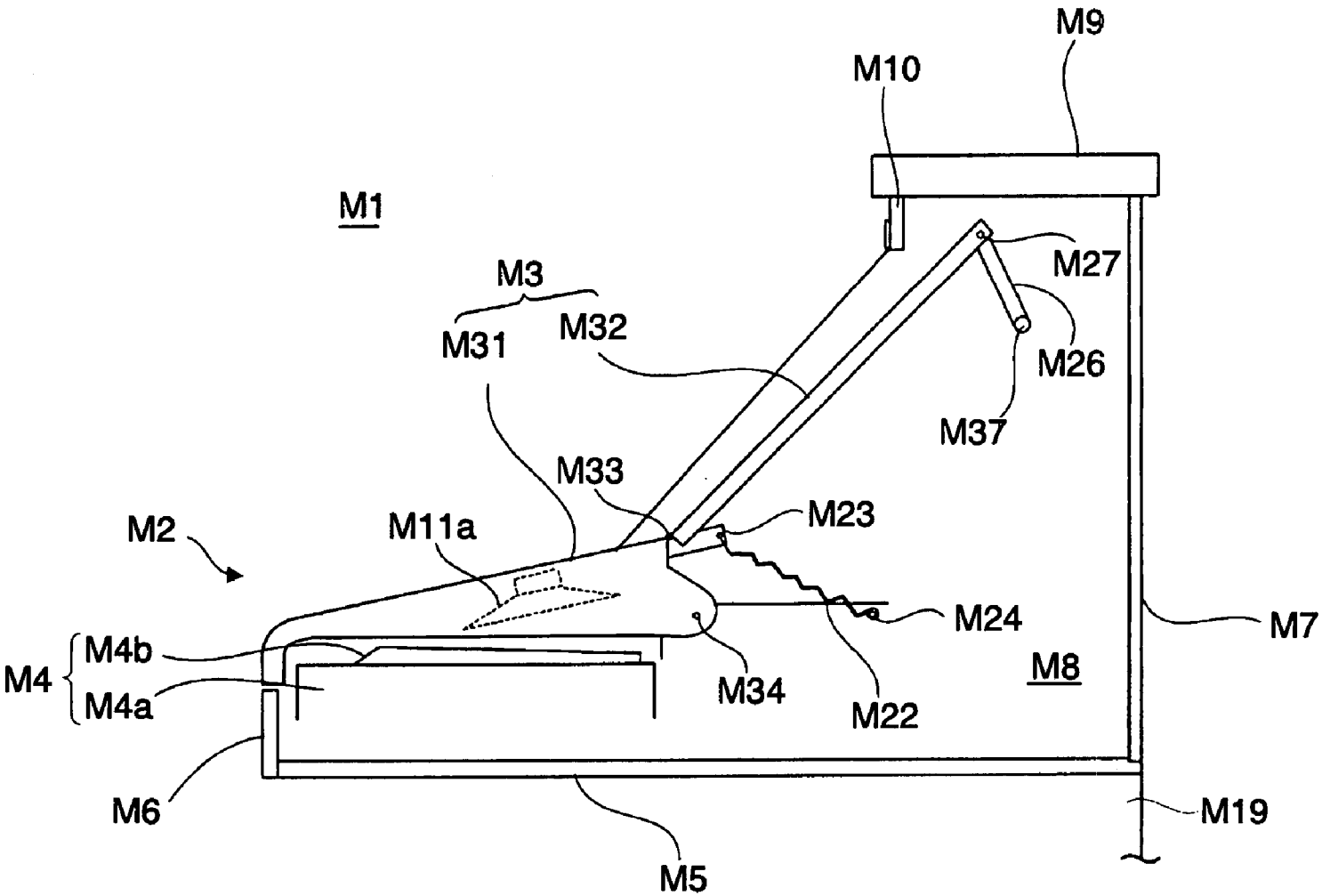
FIG. 17 is a longitudinal cross-sectional view of an electronic keyboard instrument as an electronic musical instrument according to a fifth embodiment of the present invention, in a state where a fallboard unit is closed.
Figure 18:
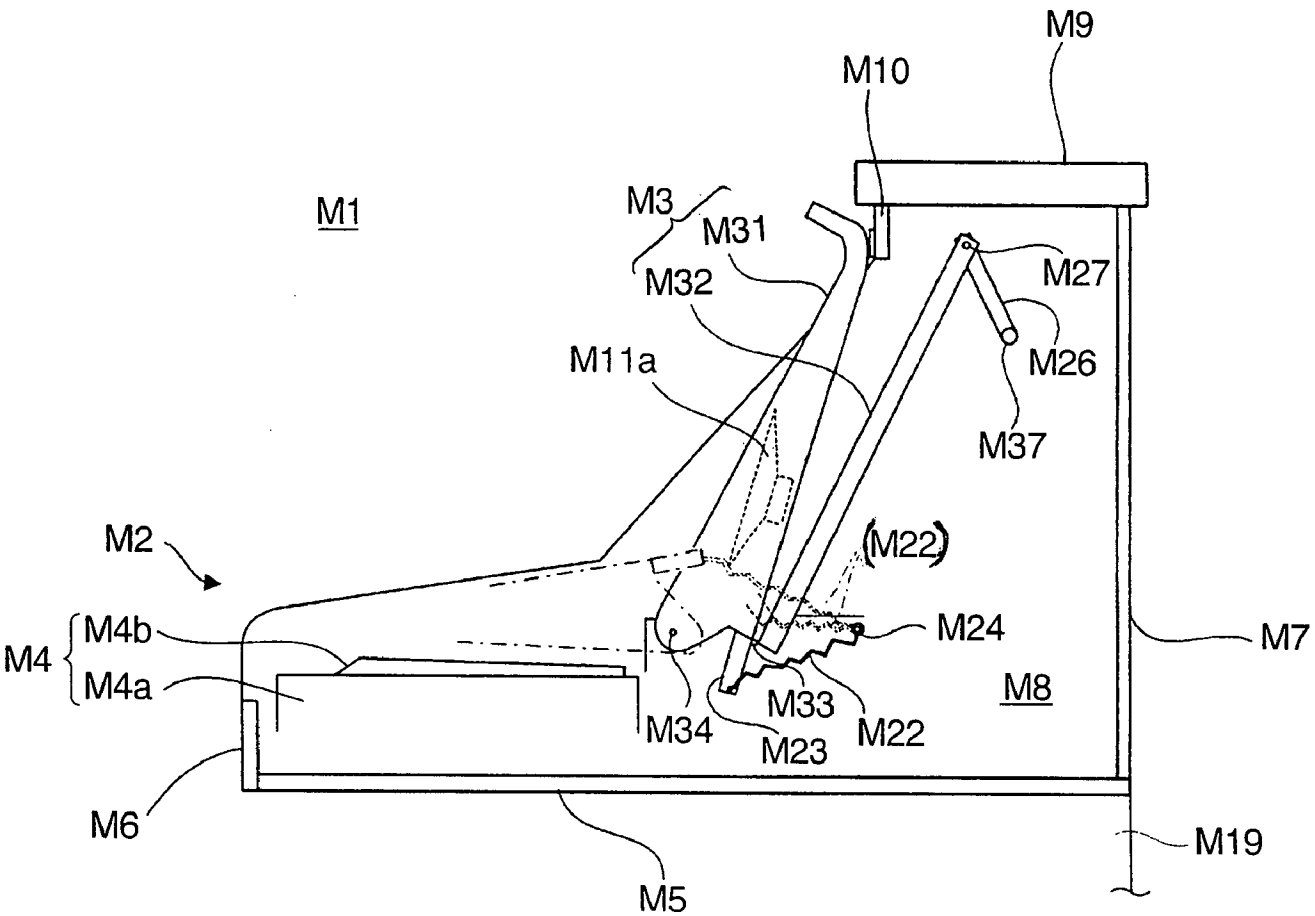
FIG. 18 is a longitudinal cross-sectional view of the electronic keyboard instrument shown in FIG. 17, in a state where the fallboard unit is open.

Next, an electronic musical instrument according to a fifth embodiment of the present invention will be described with reference to FIGS. 17 and 18. In these figures, elements and parts corresponding or similar to those of the electronic musical instrument according to the fourth embodiment are designated by identical reference numerals, and description thereof is omitted. FIG. 17 shows an electronic keyboard instrument M1 as the electronic musical instrument in a state where a fallboard unit M3 is closed, and FIG. 18 shows a state where the fallboard unit M3 is open. In the present embodiment, the instrument body M2 has a short hanging board M10 extending downward from the front end of a topboard M9. Further, legs M19 extend downward from a keybed M5 forming the bottom of the instrument body M2.

In the electronic keyboard instrument M1, the fallboard unit M3 as a fallboard assembly is comprised of a fallboard front section M31 and a fallboard rear section M32. The fallboard front section M31 and the fallboard rear section M32 are pivotally connected by a hinge member M33. The fallboard front section M31 accommodates loudspeakers M11*a* as functional components (in addition to the loudspeakers M11*a*, operating element groups, such as an operating element group for setting musical tone parameters, an operating element group for an automatic control system, and an operating element group for performance assistance, may be accommodated). The loudspeakers M11*a* are connected to a musical tone controller, not shown, within the instrument body M2 by connection wires, not shown, to generate sound together with internal loudspeakers, not shown, or external loudspeakers, not shown, according to operations of keys M4*a* and M4*b* of the keyboard 4 and other operating elements.

The fallboard unit M3 is constructed such that the fallboard front section M31 covers the keyboard M4 and the fallboard rear section M32 covers the player-side face of the instrument body M2 at a location below the topboard M9. The fallboard rear section M32 extends obliquely forward and downward. The fallboard rear section M32 has pins M27 disposed on the respective left and right side edges of the rear part thereof. Further, link members M26 are pivotally supported by pivots M37 fixed to respective lateral side panels M8, to support the fallboard rear section M32, and each of the pins M27 is pivotally connected to the free end of the associated link member M26. In the present embodiment, the fallboard rear section M32 can be deemed as a front panel of the electronic keyboard instrument M1. This is because the fallboard rear section M32 is similar in shape to the front panel of an upright keyboard instrument.

In the present embodiment, the pins M27 as connecting members for connecting between the link member M26 and the rear end of the fallboard rear section M32 are each located above the pivot M37 of the associated link member M26. This makes it possible to dispose the rear end of the fallboard rear section M32 at a high location close to the topboard M9 and secure an accommodation space within the instrument body M2. This is also advantageous in improving the appearance of the keyboard instrument M1. However, the pin M27 may be also located below the pivot M37.

The front end of the fallboard rear section M32 is pivotally connected to the rear end of the fallboard front section M31 by the above-mentioned hinge member M33. The hinge member M33 extends continuously between the opposite lateral side edges of the fallboard front section M31 and the fallboard rear section M32. The fallboard front section M31 has a sufficient thickness for receiving the loudspeakers M11*a*. The hinge member M33 is attached to the rear upper end, as viewed in the closed position, of the fallboard front section M31, and the rear lower ends of the opposite lateral side edges of the fallboard front section M31 are supported by the respective lateral side panels M8 via pivotal motion supports M34 such that the fallboard front section M31 can pivotally move (the pivotal motion supports M34 may be fixed to the lateral side panels M8 directly or via other members).

As described above, the fallboard rear section M32, the link members M26, a part of the rear end of the fallboard front section M31 in the thickness direction thereof, and the lateral side panels M8, which support the pivots 15 for the link members M26 and the pivotal motion supports M34 of the fallboard front section M31, are linked to one another to form a four-joint pivotal linkage. With this linkage, the fallboard rear section M32 moves rearward, as the fallboard front section M31 is moved from the closed position shown in FIG. 17 to the open position shown in FIG. 18, and at the same time the fallboard front section M31 is brought into a raised position in front of the fallboard rear section M32. In short, during movement of the fallboard rear section M32, the link members M26 function as guide members for guiding the rear end of the fallboard rear section M32. Such a guide mechanism can be formed by various other members. For example, the guide mechanism may be comprised of guides, such as rails or grooves, provided in the instrument body or members mounted thereon, and a slider attached to the rear end of the fallboard rear section M32, for sliding along the guides.

The fallboard front section M31 is supported by the hanging board M10 in a state slightly tilted rearward (see FIG. 18) when it is open, and in this state, the loudspeakers M11*a* are positioned with their sound-radiating surfaces facing toward the player. The fallboard front section M31 has parts formed of a net e.g. of cloth or a porous material covering the loudspeakers M11*a* so as not to block sound radiation from the loudspeakers M11*a*. This enables the player to hear musical tones directly from the loudspeakers M11*a* simultaneously with musical tones outputted from a loudspeaker, not shown, disposed in the rear of the instrument body or outside the instrument body. Thus, musical tones can be heard accurately.

Further, in the present embodiment, in accordance with downward motion of the fallboard front section M31 into a horizontal position during closing of the fallboard front section M31, the whole fallboard rear section M32 moves upward. In other words, when the fallboard front section M31 is closed, a range of pivotal motion exists in which downward shift of the center of gravity of the fallboard front section M31 and upward shift of the center of gravity of the fallboard rear section M32 cancel each other out to reduce acceleration of the lowering motion of the fallboard front section M31.

Further, a damper mechanism, as shown in FIGS. 17 and 18, may be provided for slowing down the opening and closing operations of the fallboard unit M3. The damper mechanism is comprised of engaging parts M23 extending from the opposite lateral side edges of a rear part of the fallboard front section M31, and resilient members M22, such as coil springs, each having one end thereof engaged with the associated engaging part M23, and the other end thereof engaged with a pin M24 on the associated lateral side panel M8. These members forming the damper mechanism are arranged such that the amount of extension of each resilient member M22 is large when the fallboard front section M31 is in the open position and the closed position, and small when the fallboard front section M31 is in the intermediate position between the open position and the closed position. In FIG. 18, the position of the resilient member M22 taken when the fallboard front section M31 is in the open position is indicated by solid lines, and the positions of the resilient member M22 taken when the fallboard front section M31 is in the closed position and in the intermediate position are indicated by one-dot chain lines.

As illustrated in these figures, large resilient forces of the resilient members M22 act upon the fallboard unit M3 the when the fallboard front section M31 is fully open or closed, so that the fallboard front section M31 receives larger resilient forces acting against the motion of the fallboard front section M31 as it approaches its open or closed position. This prevents the fallboard front section M31 from being abruptly brought into the open or closed position by its own gravity, whereby a danger that the player may have his/her finger caught between the fallboard front section M31 and the keyboard M4 or instrument body can be avoided. Alternatively to the construction that tensile forces are applied using the coil springs, shown in FIGS. 17 and 18, the damper mechanism may be realized by a construction that causes the rotation moment of the fallboard unit M3 to be applied in the opposite direction to the opening or closing direction of the fallboard unit M3, by interposing torsion springs between the shafts of the fallboard unit M3 and parts supporting the shaft, and any other suitable construction.

The engaging members, such as the pins M24, for supporting the resilient members M22 can be disposed on the keybed M5 or some other parts of the instrument body directly or via other members, instead of being disposed on the lateral side panels M8 as shown in FIGS. 17 and 18.

As described above, according to the present embodiment as well, the upper part of the front end of the fallboard rear section M32 is connected to the upper part of the rear end of the fallboard front section M31 having the functional components arranged therein, and the pivotal motion supports M34 are provided on the rear lower end part of the fallboard front section M31, and consequently the range of motion of the fallboard unit M3 in the longitudinal direction is reduced. Therefore, similarly to the fourth embodiment described above, it is possible to make the electronic musical instrument reduced in depth. Further, whether the fallboard unit M3 is in the closed position or in the open position, no end face thereof shows that the fallboard unit has some thickness, and therefore it is not necessary to secure a horizontal space for receiving the thick fallboard unit as in the conventional electronic musical instruments. This makes it possible to reduce the distance between the front end of the fallboard unit and the front panel, and to prevent the appearance of the electronic musical instrument from being spoiled.

Although in the above-described fifth embodiment, the fallboard unit M3 is used as a fallboard assembly for covering the keyboard M4, the mounting structure described above can also be applied to a cover unit for covering a musical tone control operator other than a keyboard.

Further, the whole instrument body M2 can be reduced in height, and therefore the player never feel oppressed. Particularly in the present embodiment, the keyboard instrument M1 can be made closer in shape to a so-called upright keyboard instrument in which a front panel corresponding to the fallboard rear section M32 in the present embodiment is in an upright position. Therefore, it is possible to obtain a quality appearance specific to the upright keyboard instrument.

The present invention is not limited to the above described embodiments, but various changes and modifications can be made. For example, the present invention is applicable not only to the electronic keyboard instrument as in the above-described embodiments, but also to a general electronic musical instrument with a fallboard unit having a sounding body built therein.

Further, alternatively to the construction that tensile forces are applied using the coil springs, shown in FIGS. 1 to 3, 13 to 15, 17 and 18, the damper mechanism may be realized by a construction that the rotation moment of the cover unit or fallboard unit is applied in the opposite direction to the opening or closing direction of the fallboard unit, by interposing torsion springs between the shafts of the cover unit or fallboard unit and parts supporting the shaft, and any other suitable construction.

Further, the guide mechanism for enabling the rear cover to move in the forward and rearward directions can be implemented by replacing the construction employed in the first embodiment or the third embodiment and the construction used in the second embodiment by each other. Further, the guide mechanism may be comprised of guides, such as rails or grooves, provided on the instrument body or members mounted thereon, and a slider attached to the rear end of the fallboard rear section, for sliding along the guides.

Further, although the above-described embodiments are directed to the cover unit and the fallboard unit for covering the keyboard, this is not limitative, but the present invention may be applied to a cover unit or fallboard unit for covering operators for musical tone control, other than the keyboard.

The present invention can be applied not only to an electronic keyboard instrument, including an electronic piano and an electronic organ, as the electronic musical instrument, but also to a musical instrument, such as an acoustic piano, a pipe organ, a cembalo or a celesta, which has a keyboard or musical tone control operators.

What is claimed is:

1. An electronic musical instrument comprising:

a keyboard that is operated for performance;

a cover unit that includes a front cover having a panel surface and a rear cover each having a front end and a rear end, said front cover and said rear cover being disposed such that said front cover and said rear cover are arranged in forward and rearward directions when said cover unit is in a closed state, and a hinge device pivotally connecting said front cover and said rear cover such that said cover unit lays open a space above said keyboard when said cover unit is in an open state where said front cover and said rear cover are folded;

at least one functional component selected from a group consisting of at least one loudspeaker, a display and operators mounted on the panel surface of said front cover;

a musical tone generator that generates musical tones;

an instrument body that accommodates said keyboard and said musical tone generator, said instrument body including at least one pivotal support member fixed therein, a guide mechanism that supports said rear cover such that said rear cover is movable in the forward and rearward directions, left and right lateral side panels;

wherein said pivotal support member pivotally supports said rear end of said front cover and has a pivotal motion support, wherein said front cover and said hinge device are pivotally movable about said pivotal motion support, and said hinge device is capable of pivotally moving until said hinge device becomes positioned below said pivotal motion support, wherein said front cover has a thickness for accommodating said functional component and accommodates said functional component therein, and wherein said panel surface of said front cover is disposed in facing relation to a player when said cover unit is in the open state, and said functional component is disposed on the panel surface of said front cover.

2. An electronic musical instrument as claimed in claim 1, wherein as said cover unit is moved from a closed position to an open position, said rear cover moves rearward while lowering its front end.

3. An electronic musical instrument comprising:

a topboard having a lower surface;

a plurality of juxtaposed operating elements;

a cover unit that covers said plurality of operating elements, said cover unit including a front cover and a rear cover each having a front end and a rear end, said front cover and said rear cover being disposed such that said front cover and said rear cover are arranged in forward and rearward directions when said cover unit is in a closed state, and a hinge device pivotally connecting said front cover and said rear cover such that said cover unit lays open a space above said keyboard when said cover unit is in an open state where said front cover and said rear cover are folded;

an instrument body that accommodates said plurality of operating elements, said instrument body including pivotal support members disposed laterally outward of said plurality of juxtaposed operating elements, said instrument body having an upper part thereof formed by said cover unit and said topboard; and at least one link member that allows said rear cover to move while acting as a damper member, said link member having one end and another end, wherein said pivotal support members are located below said hinge device and pivotally support said front cover, wherein said rear cover has the rear end thereof pivotally supported by the one end of said link member such that said rear cover pivotally moves about the one end when said cover unit is pivotally moved about said hinge device and said pivotal support members into the open state or into the closed state, the other end of said link member being supported by said instrument body in a vicinity of the lower surface of said topboard, and wherein the rear end of said rear cover pivotally supported by the one end of said link member is positioned above the front end of said rear cover when said cover unit is pivotally moved into the open state or into the closed state.

4. An electronic musical instrument as claimed in claim 3, wherein as said cover unit is moved from a closed position to an open position, said rear cover moves rearward while lowering its front end.

5. An electronic musical instrument comprising:

a plurality of juxtaposed operating elements;

a cover unit that covers said plurality of operating elements, said cover unit including a front cover having a panel surface and a rear cover each having a front end and a rear end, said front cover and said rear cover being disposed such that said front cover and said rear cover are arranged in forward and rearward directions when said cover unit is in a closed state, and a hinge device pivotally connecting said front cover and said rear cover such that said cover unit lays open a space above said keyboard when said cover unit is in an open state where said front cover and said rear cover are folded;

at least one functional component selected from a group consisting of at least one loudspeaker, a display and operators mounted on the panel surface of said front cover;

a load reducing device that reduces load applied to said front cover due to a weight of said front cover when said cover unit is opened and closed; and an instrument body that includes at least one pivotal support member fixed therein, said hinge device extending in a transverse direction of said instrument body, wherein said pivotal support member pivotally supports said rear end of said front cover and has a pivotal motion support, wherein said front cover and said hinge device are pivotally movable about said pivotal motion support, and said hinge device is capable of pivotally moving until said hinge device becomes positioned below said pivotal motion support, wherein said front cover has a thickness for accommodating said functional component and accommodates said functional component therein, wherein said panel surface of said front cover is disposed in facing relation to a player when said cover unit is in the open state, and said functional component is disposed on the panel surface of said front cover, and wherein said load reducing device comprises at least one resilient member that has a resistance force thereof increased against a motion of said front cover toward a fully open position or a fully closed position of said cover unit as said front cover approaches the fully open position or the fully closed position, said resilient member having one end thereof connected to said instrument body, and another end thereof connected to said front cover at a location remote from said hinge device in a direction perpendicular to the transverse direction of said instrument body in which said hinge device extends.

6. An electronic musical instrument as claimed in claim 5, wherein as said cover unit is moved from a closed position to an open position, said rear cover moves rearward while lowering its front end.

7. An electronic musical instrument comprising:

a plurality of performance operating elements;

an instrument body that accommodates said plurality of performance operating elements, said instrument body including at least one pivotal support member fixed therein;

a fallboard unit that covers said plurality of performance operating elements, said fallboard unit including a first fallboard member having a panel surface and a second fallboard member, said first fallboard member having a free end and another end, said second fallboard member having one end, said first fallboard member and said second fallboard member being disposed such that said first fallboard member and said second fallboard member are arranged in forward and rearward directions when said fallboard unit is in a closed state, and a hinge device pivotally connecting the other end of said first fallboard member and the one end of said second fallboard member; and at least one functional component selected from a group consisting of at least one loudspeaker, a display and operators mounted on the panel surface of said first fallboard member, wherein said first fallboard member has at least one pivotal motion support disposed such that said pivotal motion support is positioned inward of said hinge device when said fallboard unit is in a closed state, said pivotal support member having said pivotal motion support, wherein said first fallboard member has an upper surface extending between the free end of said first fallboard member and said hinge device, and a lower surface extending between the free end of said first fallboard member and said pivotal motion support, said functional component being disposed in a space defined between the upper surface of said first fallboard member and the lower surface of said first fallboard member, and wherein the upper surface and the lower surface of said first fallboard member progressively become closer to each other toward the free end of said first fallboard member such that said first fallboard member has a thickness thereof progressively reduced.

8. An electronic musical instrument as claimed in claim 7, wherein as said fallboard unit is moved from a closed position to an open position, said second fallboard member moves rearward while lowering its one end.

9. An electronic musical instrument as claimed in claim 1, wherein said guide mechanism comprises at least one link member pivotable about a predetermined pivot provided on said instrument body.

10. An electronic musical instrument as claimed in claim 1, wherein said guide instrument comprises guide grooves provided in said left and right lateral side panels.

11. An electronic musical instrument as claimed in claim 7, comprising a protective member provided on the lower surface of said first fallboard member, for protecting said functional component.

12. An electronic musical instrument as claimed in claim 11, wherein said functional component is secured to said protective member.

13. An electronic musical instrument as claimed in claim 7, wherein said second fallboard member includes a free end disposed in opposed relation to said hinge device, said free end being movable in a longitudinal direction of said instrument body.

14. An electronic musical instrument as claimed in claim 13, further comprising a link member, wherein the free end of said second fallboard member is made movable by said link member.

15. An electronic musical instrument as claimed in claim 13, comprising a guide mechanism provided in said instrument body for enabling movement by said second fallboard member.

16. An electronic musical instrument as claimed in claim 15, wherein said guide mechanism is disposed at an upper location within said instrument body.

17. An electronic musical instrument as claimed in claim 15, wherein said second fallboard member includes at least one engaging member, and wherein said guide member includes at least one groove in which said engaging member is slidably fitted.

* * * * *